US012722097B2

(12) United States Patent
Hilt

(10) Patent No.: US 12,722,097 B2
(45) **Date of Patent: *Sep. 1, 2026**

(54) TOY PROJECTILE LAUNCHING ASSEMBLY

(71) Applicant: Garrett Hilt, Bakersfield, CA (US)

(72) Inventor: Garrett Hilt, Bakersfield, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/244,413

(22) Filed: Sep. 11, 2023

(65) Prior Publication Data

US 2023/0415060 A1 Dec. 28, 2023

Related U.S. Application Data

(63) Continuation of application No. 18/235,269, filed on Aug. 17, 2023, now abandoned, which is a continuation-in-part of application No. 29/885,816, filed on Mar. 1, 2023, now Pat. No. Des. 1,010,022, and a continuation-in-part of application No. 16/841,427, filed on Apr. 6, 2020, now abandoned.

(51) Int. Cl.
*A63H 33/18* (2006.01)

(52) U.S. Cl.
CPC ..... *A63H 33/18* (2013.01)

(58) Field of Classification Search
CPC ..... F41B 1/00; F41B 3/00; F41B 5/00; F41B 7/00; F41B 15/00; F41B 7/08; F41B 11/89; F41B 5/12; F41B 5/123; F41B 5/126; F41B 3/02; A63H 33/00; A63H 33/18; A63F 9/02
See application file for complete search history.

(56) References Cited

U.S. PATENT DOCUMENTS 1,831,230 A 11/1931 Copas
2,430,685 A 11/1947 Pearson
2,565,176 A 8/1951 Hockett
(Continued)

FOREIGN PATENT DOCUMENTS

CN 104634160 A * 5/2015
CN 105973064 A * 9/2016
(Continued)

OTHER PUBLICATIONS

CN 104634160 A (Year: 2015).*
(Continued)

*Primary Examiner* — Nicholas J. Weiss
*Assistant Examiner* — Amir A Klayman
(74) *Attorney, Agent, or Firm* — Goldstein Law Offices, P.C.

(57) ABSTRACT

A toy projectile launching assembly for launching toy projectiles includes a platform defined by a rigid shallow "V-shaped" structure with a flat base portion. The flat base has an upper and lower surface including rigid left and right extensions having rigid left and right elastic supports and a rigid central region disposed between the left and right extensions, rigid interior left and right elastic supports situated between the rigid exterior left and right elastic supports, first and second elastic launching elements extending continuously from the left elastic support to the right elastic support, a handle, an arm support, and an arm support strap. Also disclosed are methods of making and using the toy projectile launching assembly.

19 Claims, 20 Drawing Sheets

(56) References Cited

U.S. PATENT DOCUMENTS 2,735,221 A 2/1956 Fields
2,808,043 A * 10/1957 Lombard ..... A01K 89/08 242/224
2,876,760 A 3/1959 Halverson
3,103,213 A 9/1963 Robinson
3,277,878 A * 10/1966 Pankratz ..... A63B 69/407 124/35.1
3,415,239 A * 12/1968 Swett ..... F41B 3/02 124/20.3
3,465,472 A 9/1969 Novotny
3,599,621 A * 8/1971 Scrobell ..... F41B 5/0031 124/90
3,802,409 A * 4/1974 Mike ..... A63B 69/407 124/79
3,918,427 A * 11/1975 Turner ..... F41B 3/02 124/20.3
3,923,035 A * 12/1975 Trotter ..... F41B 5/105 124/86
3,974,820 A * 8/1976 Ott ..... F41B 3/02 224/242
4,169,456 A 10/1979 Van House
4,227,509 A 10/1980 Jones
4,246,883 A 1/1981 Ash
4,411,248 A 10/1983 Kivenson
4,530,342 A 7/1985 Simo
4,593,673 A * 6/1986 Kees ..... F41B 3/005 124/20.3
4,651,707 A 3/1987 Bozek
4,662,344 A * 5/1987 Mitchell ..... F41B 5/0094 124/24.1
4,703,744 A 11/1987 Taylor et al.
4,957,093 A * 9/1990 Hamlett ..... F41B 5/14 124/24.1
4,976,250 A * 12/1990 Jeffrey ..... F41B 5/1403 124/44.5
5,016,601 A * 5/1991 Ferguson ..... F41B 3/02 124/87
5,224,464 A * 7/1993 Burnham ..... F41B 11/642 124/16
5,230,323 A * 7/1993 Saunders ..... F41B 3/02 124/17
5,279,276 A 1/1994 Nagel et al.
5,345,922 A * 9/1994 Ott ..... F41B 3/02 124/16
5,531,209 A 7/1996 Liedtke
5,651,354 A * 7/1997 La Haise, Sr. ..... F41B 5/0052 124/88
5,673,677 A 10/1997 Wing
5,678,528 A * 10/1997 Hadley ..... F41B 5/12 124/25.5
6,076,513 A * 6/2000 Doherty ..... F41B 11/89 124/66
7,168,424 B1 * 1/2007 Wing ..... F41B 3/02 124/20.1
7,708,004 B2 * 5/2010 Moss ..... F41B 5/10 124/88
7,748,369 B2 * 7/2010 Chee ..... F41F 7/00 124/20.3
8,387,604 B1 * 3/2013 Terzo ..... F41B 5/123 124/25
8,485,168 B2 * 7/2013 Walterscheid ..... F41B 3/02 124/20.1
8,567,376 B2 10/2013 Flint
8,578,918 B1 11/2013 Islas
8,662,060 B2 3/2014 Walterscheid et al.
8,689,773 B2 4/2014 Walterscheid et al.
9,091,514 B1 7/2015 Cummings
D738,440 S 9/2015 Cummings
9,239,205 B2 1/2016 Cummings
9,255,756 B1 * 2/2016 Wu ..... F41B 5/123
9,310,156 B2 4/2016 Whitaker et al.
9,389,041 B2 7/2016 Novikov
9,395,141 B2 * 7/2016 Cummings ..... F41B 5/1411
9,476,666 B1 * 10/2016 Larner ..... F41B 5/00
9,513,079 B1 * 12/2016 Missel ..... F41B 5/143
9,513,080 B1 * 12/2016 Kempf ..... F41B 5/1411
9,658,024 B1 5/2017 Trpkovski
10,018,443 B2 * 7/2018 Dziekan ..... F41B 5/123
10,184,749 B2 1/2019 Trpkovski
10,288,047 B2 5/2019 Polanich
10,422,605 B2 9/2019 Shapiro
10,466,010 B2 11/2019 Polanich
10,859,338 B2 12/2020 Polanich
10,976,142 B1 4/2021 Hilt
11,156,428 B1 * 10/2021 Nishihira ..... F41B 5/105
11,402,172 B2 * 8/2022 Liu ..... F41B 5/123
11,635,274 B2 * 4/2023 Trpkovski ..... F41B 5/123 124/25
11,802,748 B1 * 10/2023 Wei ..... F41B 5/123
11,828,564 B2 * 11/2023 Moriyasu ..... F41B 5/10
D1,072,066 S * 4/2025 Winegarner ..... D21/454
2008/0053421 A1 3/2008 Chang
2008/0172944 A1 7/2008 Bartlett
2008/0295816 A1 12/2008 Edwards
2009/0032002 A1 2/2009 Howard et al.
2009/0313873 A1 * 12/2009 Roth ..... F41C 23/16 42/72
2012/0037137 A1 2/2012 Thurmon
2014/0165981 A1 6/2014 Lien
2014/0238371 A1 8/2014 Yamazaki et al.
2014/0238372 A1 8/2014 Chirico
2015/0090237 A1 * 4/2015 Williams ..... A63B 65/122 124/16
2015/0226512 A1 * 8/2015 Butsook ..... F41B 3/02 124/20.3
2015/0260475 A1 * 9/2015 Monnig ..... F41A 11/04 124/20.1
2016/0313084 A1 * 10/2016 Hunter ..... F41B 5/10
2018/0321009 A1 11/2018 Shapiro
2019/0011215 A1 1/2019 Shaffer et al.
2020/0182582 A1 6/2020 Pauluhn et al.
2021/0080218 A1 * 3/2021 Trpkovski ..... F41B 5/123
2021/0172697 A1 6/2021 Gray
2024/0191963 A1 * 6/2024 Barnett ..... F41B 5/105

FOREIGN PATENT DOCUMENTS

FR 2837918 A1 * 10/2003 ..... F41B 3/02
GB 2230466 A * 10/1990 ..... F41B 3/02
WO WO-03081161 A1 * 10/2003 ..... F41B 3/02
WO WO-2008010745 A1 * 1/2008 ..... A01K 81/00

OTHER PUBLICATIONS

CN 105973064 A (Year: 2016).*
WO 2008010745 A1 (Year: 2008).*
FR 2837918 A1 (Year: 2003).*
WO 03081161 A1 (Year: 2003).*
International Preliminary Report on Patentability of the International Preliminary Examining Authority for PCT/US2021/021630 established by the ISA/US completed on Oct. 6, 2022.
Written Opinion of the International Searching Authority for PCT/US2021/21630 established by the ISA/US completed on May 25, 2021.

* cited by examiner

TOY PROJECTILE LAUNCHING ASSEMBLY

CROSS-REFERENCE TO RELATED APPLICATIONS

This application is a Continuation of U.S. patent application Ser. No. 18/235,269, filed Aug. 17, 2023, which is a Continuation-In-Part of U.S. patent application Ser. No. 16/841,427, filed Apr. 6, 2020, and U.S. Design Pat. application No. 29/885,816, filed Mar. 1, 2023, which are relied upon and incorporated herein by reference in their entirety and to which priority is claimed. The entire disclosure of any publication or patent document mentioned herein is entirely incorporated by refence.

TECHNICAL FIELD

The present disclosure relates generally to toy bow and arrow systems. More particularly, the present disclosure relates to a toy bow assembly for launching toy arrow projectiles. The present disclosure also relates generally to a toy projectile launch assembly. More particularly, the present disclosure relates to a toy projectile launch assembly for launching toy projectiles.

BACKGROUND

Toy bow and arrow sets designed for children's play are now being manufactured as rigid structures with fewer moving components to form safer assemblies. An elastic string is used to create the arrow launching force and prevent bending of the bow. Indeed, if the elastic string is overdrawn, there is no significant chance of the bow breaking. Rather, the elastic string will break and will most likely move in a direction away from the person drawing the bow. However, some dangers in the elastic string breaking are still present depending upon where the elastic string breaks and how much energy is stored in the elastic string at the time it breaks. Thus, to make these toy bow and arrow assemblies even safer, toy bow and arrows sets are employing two distinct elastic elements each terminating in a separate and distinct loop structure. The idea is that since there are two elastic loops, each elastic loop need only provide half the force needed to project the arrow projectile into flight, thereby making it more difficult to overstretch the elastic elements and reducing potential failure of the elastic elements.

However, there are drawbacks to the separate and distinct elastic loop structures in that they hinder the launch projection of the toy arrow projectile. Indeed, since there are two distinct elastic components as opposed to one, more rotational pull is created on the arrow projectile during launch, which thwarts its projection. Moreover, current toy bow and arrow sets provide no means for stabilizing the bow as the elastic element is drawn. Rather, they simply have a handle for grasping while drawing the elastic element, which creates tension in one direction and tension on the band in a separate direction. This tension impedes the launch of the arrow projectile, thereby thwarting its projection.

Accordingly, there is a need for a toy projectile launching assembly that eliminates rotational pull created by the elastic element and stabilizes the bow during launch of the arrow projectile, while still reducing the dangers to a child caused by the potential overdrawing of the bow to the point of breaking.

Accordingly, there is a need for a toy projectile launching assembly that: eliminates rotational pull on the toy projectile created by the elastic element; stabilizes the toy projectile launching assembly during launch of the projectile; and reduces the dangers to a user (e.g., a child or a challenged of inexperienced adult) caused by the potential overdrawing of the elastic elements.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a toy projectile launching assembly that is capable of launching a toy projectile while minimizing the rotational pull created by the launch of the toy projectile. Accordingly, the present disclosure provides a toy projectile launching assembly including a pair of continuously extending parallel elastic launching elements that are engageable by a toy projectile and move in concert over substantially linear trajectories or axes so as to prevent rotational pull during launch.

An aspect of an example embodiment of the present disclosure is to provide a toy projectile launching assembly including a handle that is positioned outside of the launch area so as to prevent interference with the launch of the toy projectile by a hand grasping the handle. Accordingly, the present disclosure provides a handle separated by a platform over which the toy projectile is launched, thereby creating a clear separating structure that separates a user's hand from the launch site.

An aspect of an example embodiment of the present disclosure is to provide a toy projectile launching assembly that is better stabilized during operation. Accordingly, the present disclosure provides an arm support that is configured to engage the wrist or the forearm of a user's arm when the handle is grasped by the user's hand so as to stabilize the toy projectile assembly while drawing and releasing the pair of elastic launching elements.

An aspect of an example embodiment in the present disclosure is to provide an improved toy projectile launching assembly that is capable of launching a toy projectile while minimizing the rotational pull created by the launch of the toy projectile on the projectile and the assembly. Accordingly, the present disclosure provides a toy projectile launching assembly including a platform defined by a rigid shallow "V-shaped" structure with a flat base, and a pair of continuously extending parallel elastic launching elements that are engageable by a toy projectile, and the elastic elements stretch in concert over substantially linear trajectories or axes so as to prevent rotational pull during launch.

An aspect of an example embodiment of the present disclosure is to provide a toy projectile launching assembly including a handle that is positioned outside of the launch area so as to prevent interference with the launch of the toy projectile by a hand grasping the handle. Accordingly, the present disclosure provides a handle separated by a platform over which the toy projectile is launched, thereby creating a clear separating structure that separates a user's hand from the launch site.

An aspect of an example embodiment of the present disclosure is to provide a toy projectile launching assembly that is better stabilized during operation. Accordingly, the present disclosure provides an arm support that is configured to engage the wrist or the forearm of a user's arm when the handle is grasped by the user's hand so as to stabilize the toy projectile assembly while drawing and releasing the pair of elastic launching elements.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
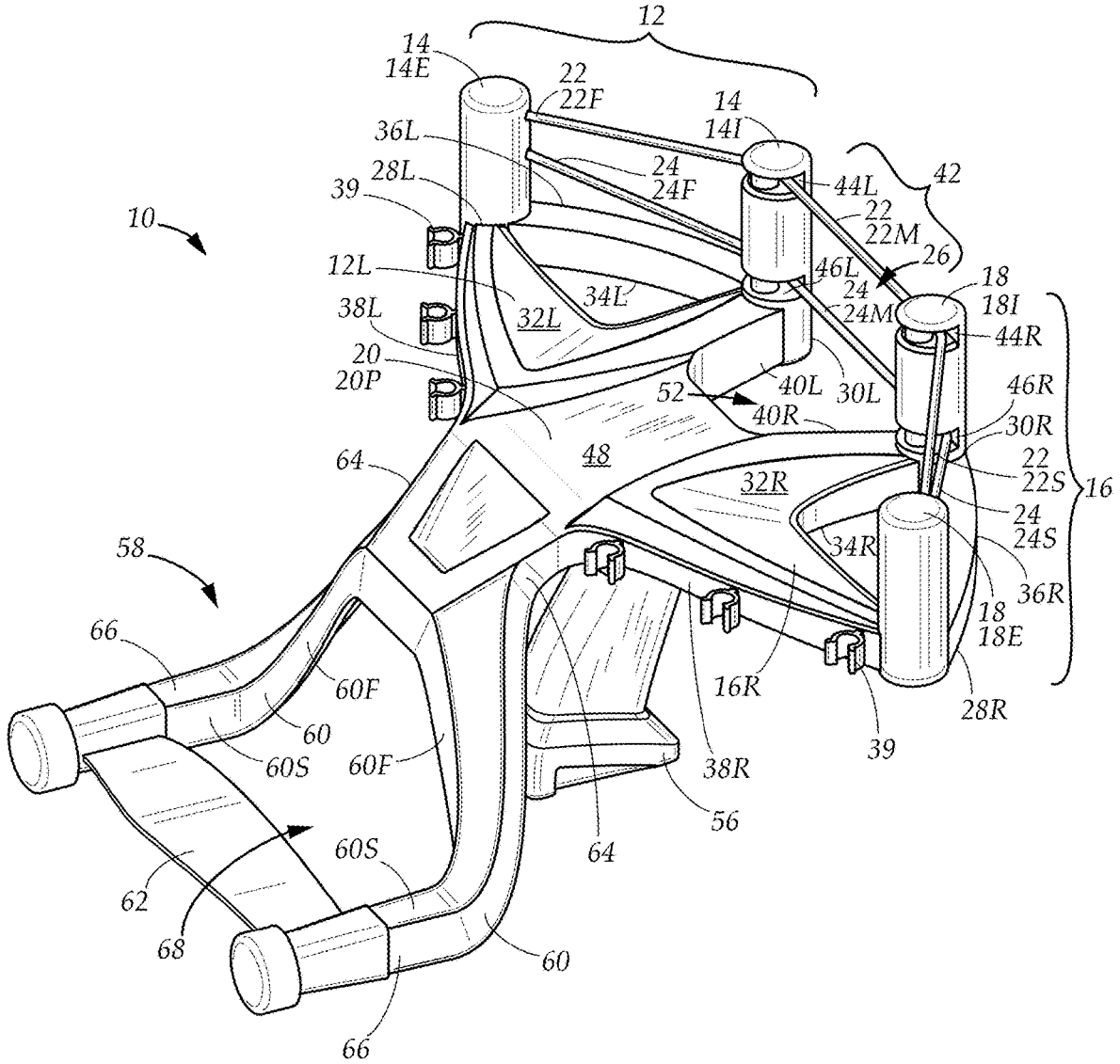
FIG. 1 is a perspective view of the toy projectile launching assembly according to one embodiment of the present disclosure.

Referring to the Figures, FIG. 1 illustrates a toy projectile launching assembly 10 configured to launch toy arrow projectiles. The toy projectile launching assembly 10 comprises a rigid crossbow structure including a left wing 12 having a left elastic support 14, a right wing 16 having a right elastic support 18, a central region 20 disposed between the left wing 12 and the right wing 16, a first elastic launching element 22 extending continuously from the left elastic support 14 to the right elastic support 18, and a second elastic launching element 24 extending continuously from the left elastic support 14 to the right elastic support 18. The first and second elastic launching elements 22, 24 are configured to bend and/or pivot about the left and right elastic supports 14, 18 and stretch rearwardly over the central region 20 to launch a toy projectile.

Figure 6A:
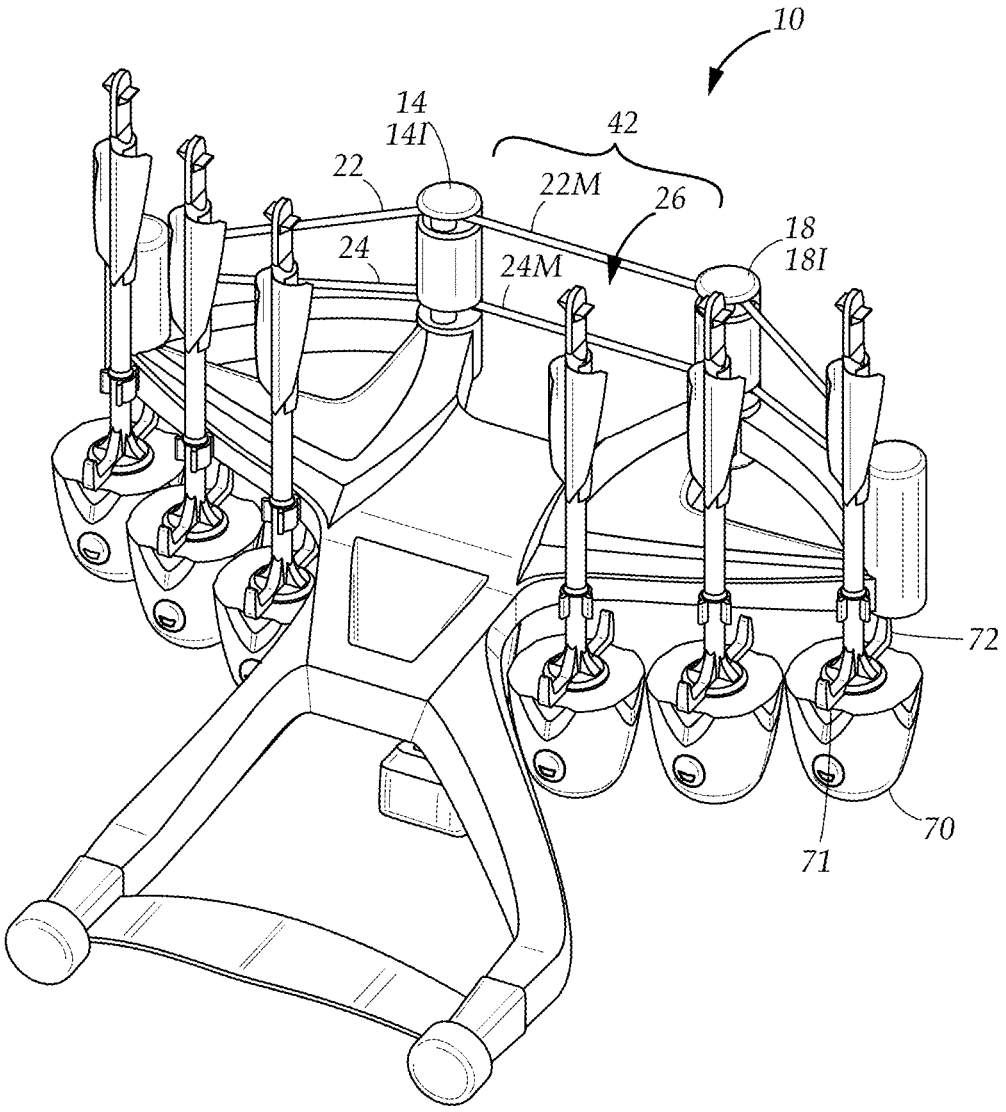
FIG. 6A is a perspective view of the toy projectile launching assembly with a toy arrow projectile mounted thereon, illustrating one manner in which the toy projectile launching assembly may hold toy arrow projectiles thereon according to one embodiment of the present disclosure.
Figure 6B:
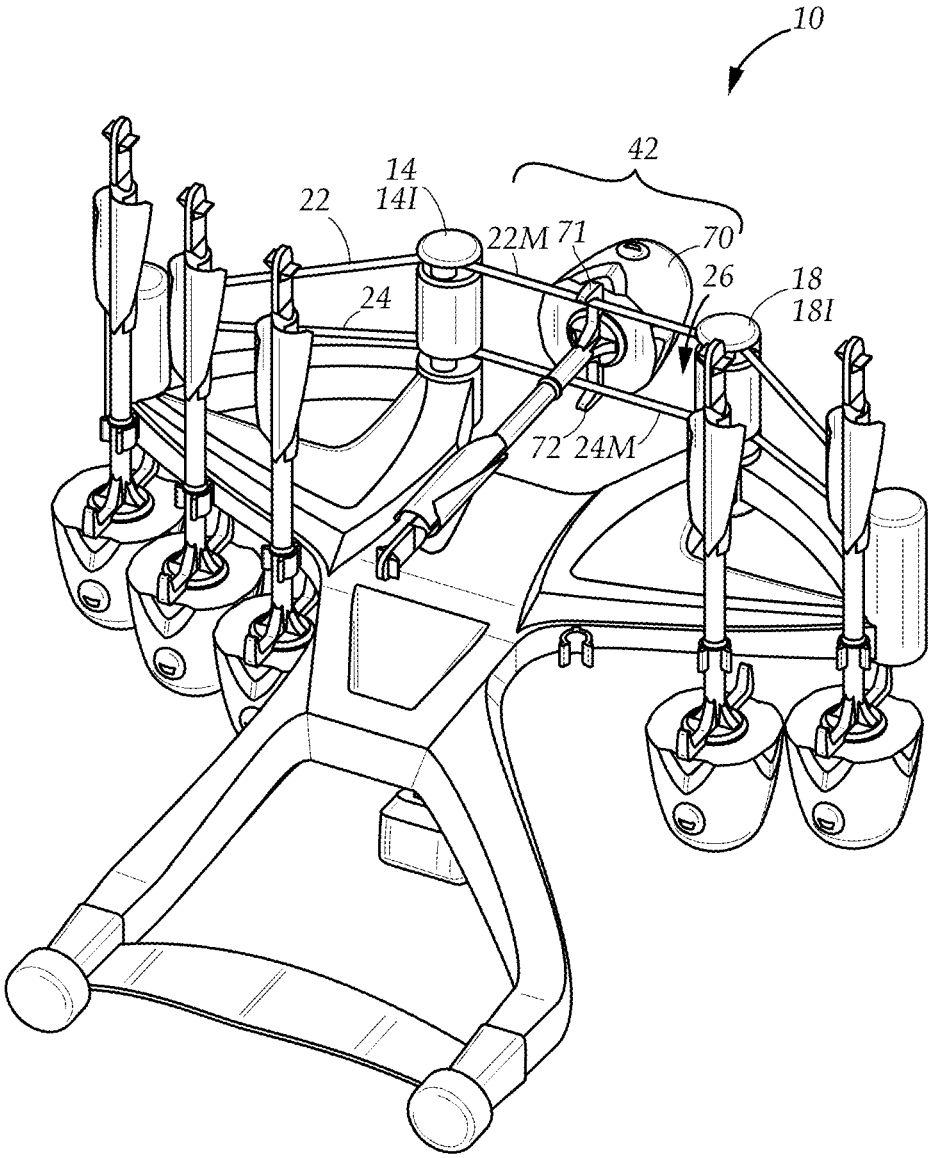
FIG. 6B is a perspective view of the toy projectile launching assembly in use, illustrating one manner in which the elastic launching element is engaged with a toy arrow projectile to position the toy arrow projectile for launch with the elastic launching element according to one embodiment of the present disclosure.
Figure 6C:
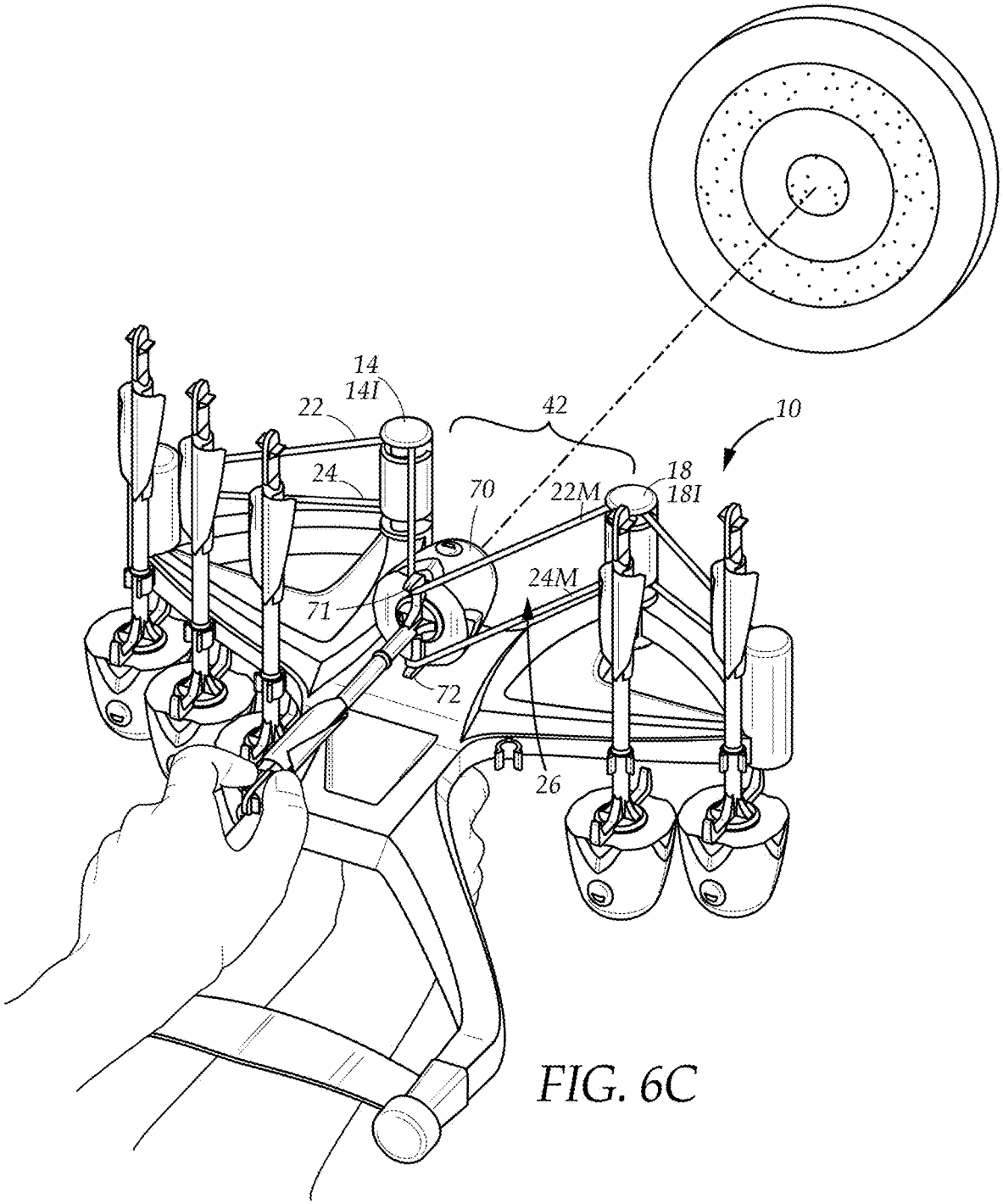
FIG. 6C is a perspective view of the toy projectile launching assembly in use, illustrating the toy projectile launching assembly stabilized on an arm with the arm support and the elastic launching element drawn back with the toy arrow projectile prior to launch according to one embodiment of the present disclosure.

The left wing 12 defines a left body 12L including an outer end 28L, an inner end 30L, an upper surface 32L, a lower surface 34L opposite the upper surface 32L, a distal side 36L, a proximal side 38L, and an inner side 40L. The right wing 16 defines a right body 16R including an outer end 28R, an inner end 30R, an upper surface 32R, a lower surface 34R opposite the upper surface 32R, a distal side 36R, a proximal side 38R, and an inner side 40R. The central region 20 connects the left wing 12 to the right wing 16. The left wing 12 and the right wing 16 are symmetrical about the central region 20. The first elastic launching element 22 and the second elastic launching element 24 extend along the distal side 36L of the left body 12L and the distal side 36R of the right body 16R. In embodiments, the proximal side 38L of the left body 12L and the proximal side 38R of the right body 16R include one or more fasteners 39 for removably receiving toy arrow projectiles, as shown in FIGS. 6A-6C.

The left elastic support 14 comprises a left exterior post 14E disposed on the outer end 28L of left body 12L and a right interior post disposed 14I on the inner end 30L of the left body 12L. The left exterior post 14E and the left interior post 141 extend substantially orthogonally upwardly from the upper surface 32L of the left body 12L.

The right elastic support 18 comprises a right exterior post 18E disposed on the outer end 28R of right body 16R and a right interior post 18I disposed on the inner end 30R of the right body 16R. The right exterior post 18E and the right interior post 181 extend substantially orthogonally upwardly from the upper surface 32R of the right body 16R. The left exterior post 14E and the right exterior post 18E are symmetrical about the central region 20. The left interior post 141 and the right interior post 181 are symmetrical about the central region 20.

The first elastic launching element 22 and the second elastic launching element 24 are coplanar and extend substantially parallel relative to each other above the central region 20. In this way, the first and second elastic launching elements 22, 24 may pivot and stretch in concert. The first elastic launching element 22 comprises a first end 22F and a second end 22S. The second elastic launching element 24 comprises a first end 24F and a second end 24S. The first elastic launching element 22 and the second elastic launching element 24 are anchored to the left exterior post 14E and the right exterior post 18E. In embodiments, the first end 22F of the first elastic launching element 22 and the first end 24F of the second elastic launching element 24 are attached within the left exterior post 14E. The second end 22S of the first elastic launching element 22 and the second end 24S of the second elastic launching element 24 are attached within the right exterior post 18E. In this way, the first ends 22F, 24F are anchored to the left exterior post 14E and the second ends 22S, 24S are anchored to the right exterior post 18E.

Figure 5A:
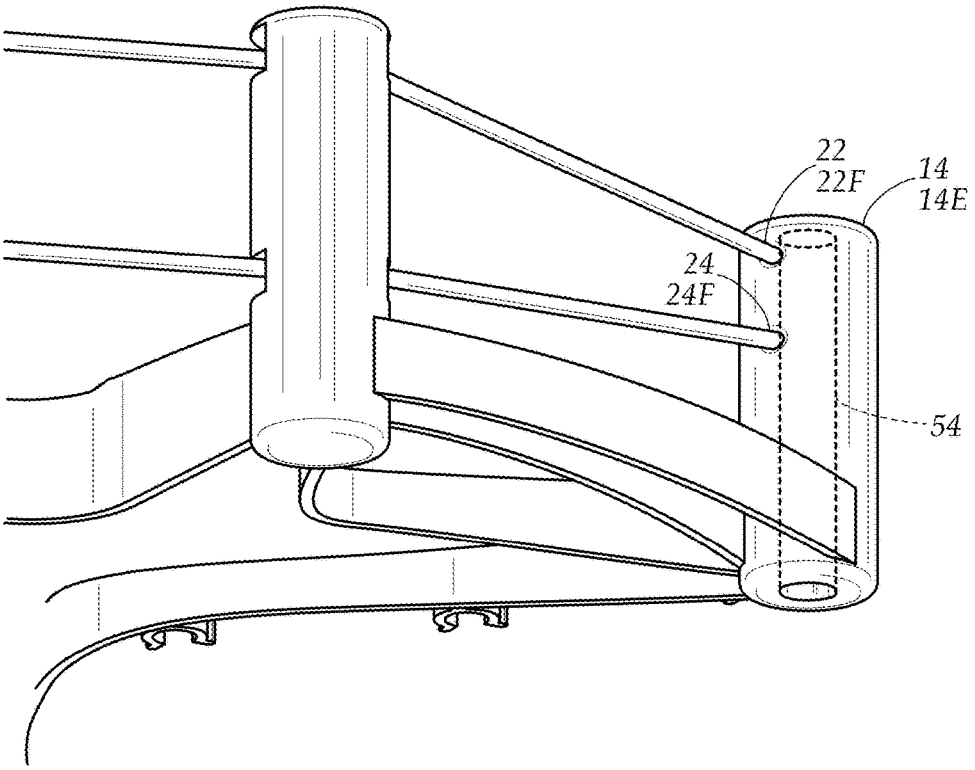
FIG. 5A is a perspective close-up view of the left wing of the toy projectile launching assembly, illustrating the interior post and exterior post and the interior cavity of the exterior post in which one end of the elastic launching element terminates according to one embodiment of the present disclosure.
Figure 5B:
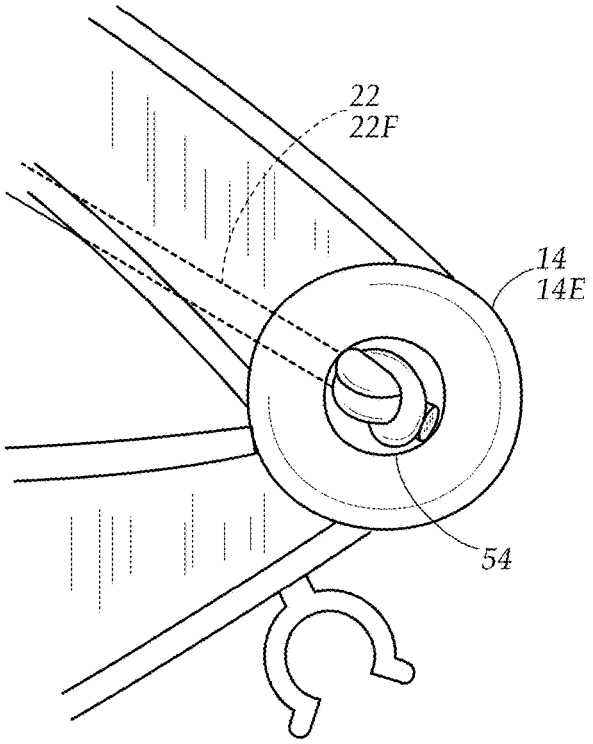
FIG. 5B is a bottom plan view of the exterior post of the left wing of the toy projectile launching assembly, illustrating one manner in which the elastic launching element is fastened within the interior cavity of the exterior post according to one embodiment of the present disclosure.

FIGS. 5A-5B, shows an interior cavity 54 disposed within the left exterior post 14E and the right exterior post (not shown) in which the first ends 22F, 24F of the first and second elastic launching elements 22, 24 and the second ends (not shown) of the first and second elastic launching elements 22, 24 are anchored. In some embodiments, the first ends 22F, 24F are knotted within the left exterior post 14E and the second ends (not shown) are anchored to the right exterior post (not shown).

Referring back to FIG. 1, the left interior post 141 and the right interior post 181 each include a first aperture 44L, 44R and a second aperture 46L, 46R. The first elastic launching element 22 is guided through the first aperture 44L of the left interior post 141 and the first aperture 44R of the right interior post 181. The second elastic launching element 24 is guided through the second aperture 46L of the left interior post 141 and the second aperture 46R of the right interior post 181.

The first elastic launching element 22 and the second elastic launching element 24 each include a continuous midpoint region 22M, 24M spanning between the left interior post 141 and the right interior post 18I that is configured to stretch to launch the toy arrow projectile. The midpoint regions 22M, 24M move and/or stretch in concert when stretching to launch the toy arrow projectile and define the regions of the first and second launching elements 22, 24 that act on the toy projectile to launch the same. The midpoint regions 22M, 24M of the first and second elastic launching elements 22, 24 define a gap 26 therebetween that is sized to allow movement of a toy arrow projectile therethrough.

The left interior post 141 and the right interior post 181 are proximate to the central region 20 and define a launch region 42 therebetween about which the first elastic launching element 22 and the second elastic launching element 24 are configured to stretch and launch the toy arrow projectile. The left interior post 14I and the right interior post 181 each define the pivot about which the first elastic launching element 22 and the second elastic launching elements 24 bend and/or pivot in concert when stretching.

The first elastic launching element 22 and the second elastic launching element 24 are biased towards the left interior post 141 and right interior post 181, such that the further the first elastic launching element 22 and the second elastic launching element 24 are stretched away from the left interior post 141 and right interior post 18I the more elastic potential energy is created in the first elastic launching element 22 and the second elastic launching element 24.

Figure 2:
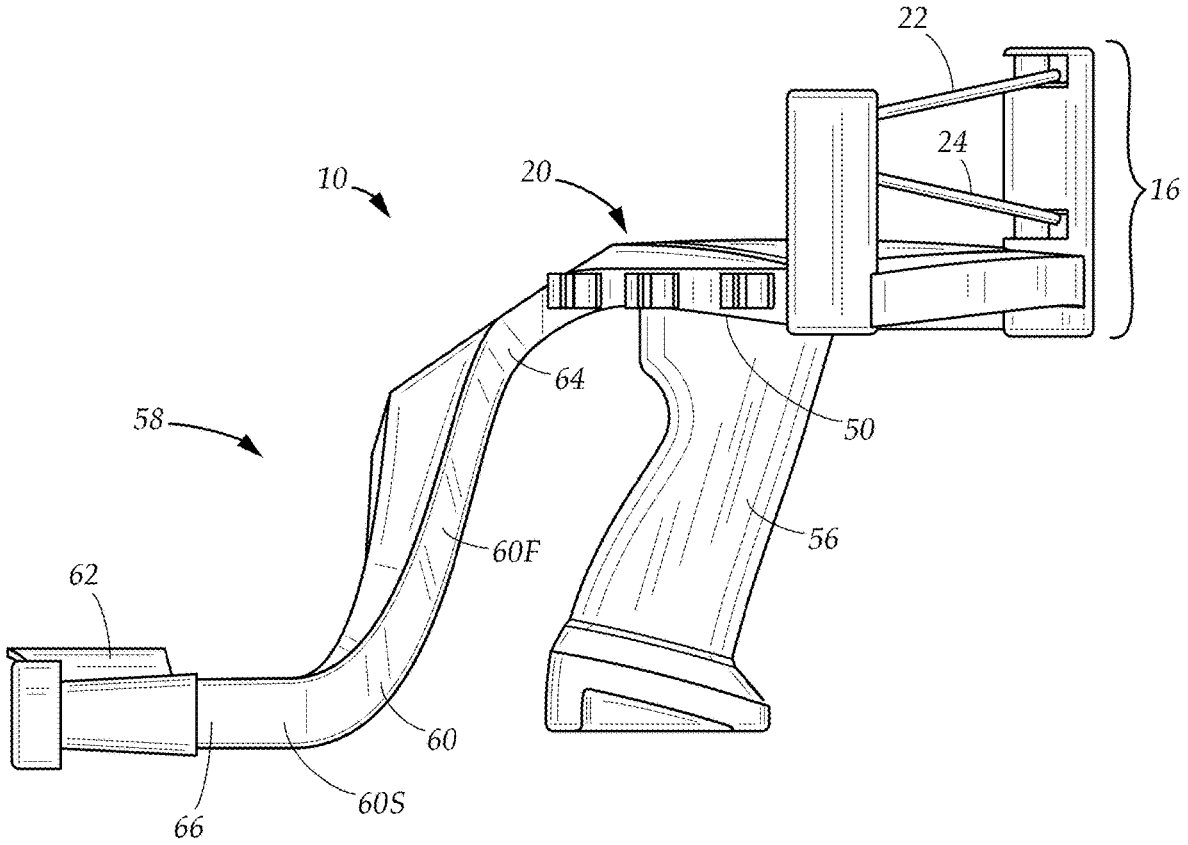
FIG. 2 is a side view of the toy projectile launching assembly according to one embodiment of the present disclosure.

The central region 20 includes an upper surface 48 and a lower surface 50(see FIG. 2). The upper surface 48 of the central region 20 is stepped downwardly relative to the upper surface 32R of the right wing 16 and the upper surface 32L of the left wing 12 such that the central region 20 is positioned on a lower horizontal plane relative to a horizontal plane of the right wing 16 and a horizontal plane of the left wing 12. In this way, the central region 20 does not obstruct the launch of a toy arrow projectile. In embodiments, the upper surface 32L of the left wing 12 and the upper surface 32R of the right wing 16 are coplanar, while the central region is positioned in a horizontal plane below the plane of the upper surfaces 32L, 32R of the left and right wings 12, 16.

The central region 20 defines a platform 20P connecting the inner side 40L of the left body 12L to the inner side 40R of the right body 16R. The central region 20 forms a space 52 between the inner side 40L of the left body 12L and the inner side 40R of the right body 16R, such that the continuous midpoint regions 22M, 24M of the first elastic launching element 22 and the second elastic launching element 24 are disposed above the space 52. The space 52 formed by the central region 20 is for the purpose of creating a clearance between first and second elastic launching elements 22, 24 and the platform 20P to prevent obstruction or interference by the platform 20P during launch of the toy arrow projectile. The platform 20P provides an area where a user may rest a toy arrow projectile when operating the toy projectile launching assembly 10, for instance before or after engaging the first and second launching elements 22, 24.

Figure 3:
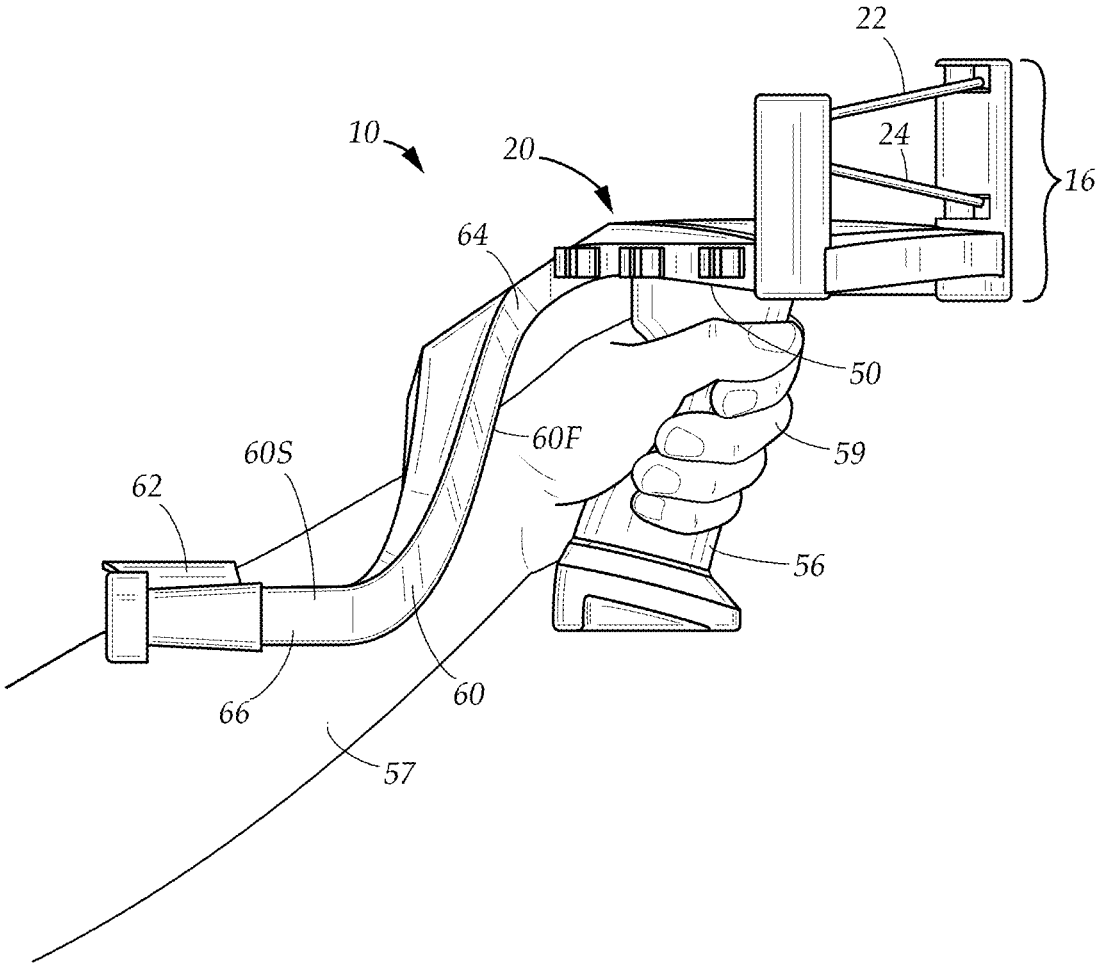
FIG. 3 is a side view of the toy projectile launching assembly in use, illustrating the arm support mounted on a wrist/forearm to stabilize the toy projectile launching assembly according to one embodiment of the present disclosure.

Referring to FIGS. 2 and 3, in conjunction with FIG. 1, the toy projectile launching assembly 10 comprises a handle 56 extending substantially orthogonally downwardly from the lower surface 50 of the central region 20 and an arm support 58 extending outwardly from the central region 20, such that the handle 56 is separated from the launch region (see FIG. 1) by the central region 20. The handle 56 defines a midline axis of the toy projectile launching assembly 10 over which the left wing 12 and the right wing 16 are symmetrical. In embodiments, the handle 56 comprises a pistol grip.

The arm support 58 extends away from the handle 56 so as to engage a user's arm 57 when the user is grasping the handle 56 with his or her hand59. When engaging the user's arm 57, the arm support 58 stabilizes the toy projectile assembly 10 while the user is drawing or stretching and releasing the first and second elastic launching elements 22, 24.

The arm support 58 comprises a pair of symmetrical arms 60 and an arm band 62 that connects the pair of arms 60 to each other. The arm band 62extends substantially parallel relative to the left wing 12 and the right wing16. The arm band 62 is configured to engage the user's arm 57 when the handle 56 is grasped. Each of the pair of arms 60 comprises a proximal end 64 and a distal end 66. In embodiments, the arm band 62 is arcuate to conform to the contours or the user's arm 57. The pair of arms 60 are connected to the central region 20 at the proximal ends 64. The pair of arms 60 converge at the proximal ends 64 and diverge towards the distal ends 66. The arm band 62 connects the distal ends 66 of the pair of arms 60 to define an opening 68 between the distal ends 66 and the proximal ends 64. The opening 68 is configured to accommodate at least a portion of the user's arm 57 therethrough when the arm band 62 is engaging the user's arm 57 and the user is grasping the handle 56. In this way, the arm support 58 does not interfere with the user's ability to grasp the handle 56. Each of the pair of arms 60 comprises a first region 60F adjacent the proximal end 64 and a second region 60S adjacent the distal end 66. The first region 60F bends into the second region 60S such that the first region60F extends substantially parallel relative to the handle 56 and the second region 60S extends substantially orthogonal relative to the handle 56.

Referring to FIGS. 6A-6C, in embodiments, the toy projectile launching assembly 10 comprises toy arrow projectiles 70. The toy arrow projectiles70 includes a pair of hook elements 71, 72. The pair of hook elements 71, 72 are sized and shaped to engage the midpoint regions 22M, 24M of the first and second elastic launching elements 22, 24 as the pair of hook elements 71, 72 are pulled though the gap 26 formed between the midpoint regions 22M, 24M. To load the toy arrow projectile 70, the toy arrow projectile 70 is threaded through the gap 26 within the launch region42 so that the pair of hook elements 71, 72 engage the midpoint regions22M, 24M of the first and second elastic launching elements 22, 24. Once engaged with the midpoint regions 22M, 24M the toy arrow projectile 70 is drawn in a manner similar to a traditional crossbow. As the toy arrow projectile 70 is drawn away from the launch region 42 the first and second elastic launching elements 22, 24 stretch. The midpoint regions 22M, 24M bend and pivot about the left and right interior posts 141, 181, thereby enabling the first and second elastic launching elements 22, 24 to move with the toy arrow projectile 70.

As the first and second elastic launching elements 22, 24 stretch, they gain potential energy. When the toy arrow projectile 70 is released, the first and second elastic launching elements 22, 24 retract and the toy arrow projectile 70 is accelerated towards the launch region 42. At the launch region 42, the midpoint regions 22M, 24M of the first and second elastic launching elements 22, 24 retracts through the launch region 42. The momentum in the toy arrow projectile 70 formed by the retraction of the first and second elastic launching elements 22, 24 causes the toy arrow projectile 70 to continue forward through the launch region 42 and out of the gap 26. This launches the toy arrow projectile 70 into flight as the pair of hook elements 71, 72 disengage the midpoint regions 22M, 24M of the first and second elastic launching elements 22, 24.

Figure 4A:
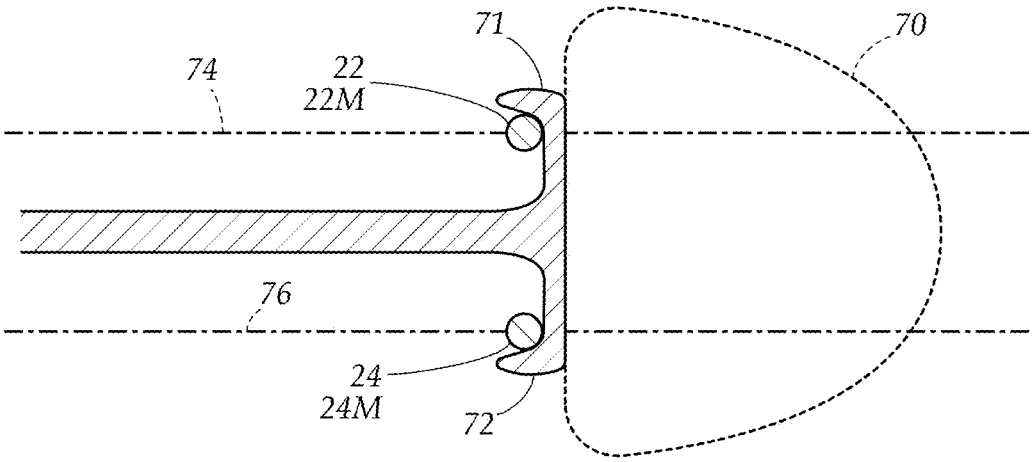
FIG. 4A is a cross-sectional view of the toy arrow projectile engaging the elastic launching element of the toy projectile launching assembly prior to the elastic launching element being stretched for launch, illustrating the axes upon which the elastic launching element travels while being drawn back and during launch according to one embodiment of the present disclosure.
Figure 4B:
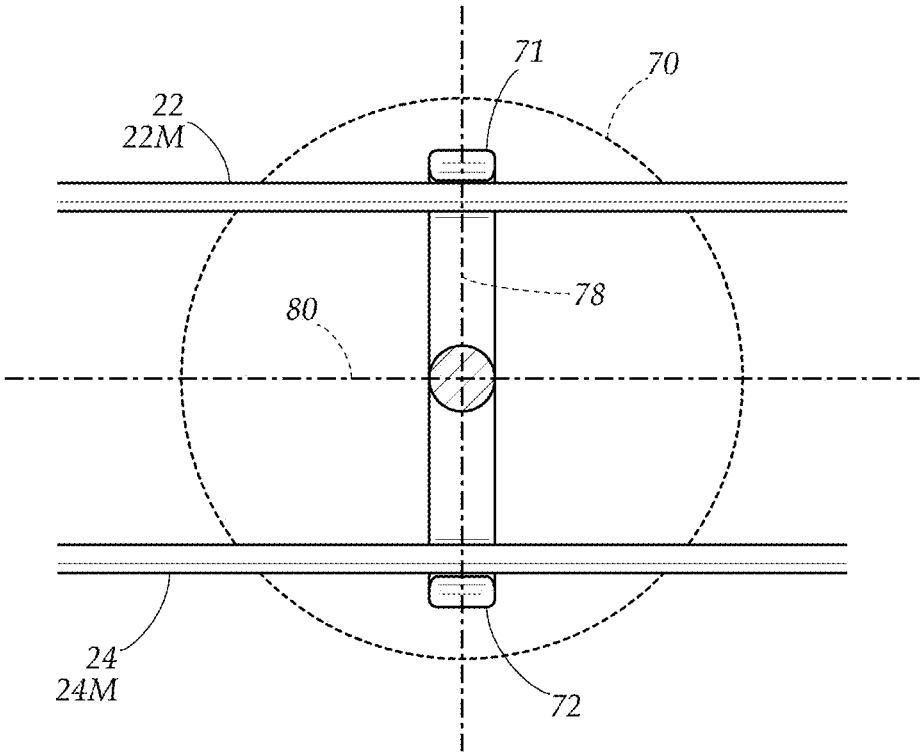
FIG. 4B is a cross-sectional view of the toy arrow projectile engaging the elastic launching element of the toy projectile launching assembly prior to the elastic launching element being stretched for launch, illustrating the horizontal and vertical axes upon which the toy arrow projectile applies a force to the elastic launching element while being drawn back according to one embodiment of the present disclosure.

Referring to FIGS. 4A and 4B, it may be seen that the first and second elastic launching elements 22, 24 are configured to stretch along separate but parallel axes 74, 76, respectively. The midpoint regions 22M, 24M of the first and second elastic launching elements 22, 24 maintain a fixed normal distance relative to each other when being drawn and when retracting to launch the toy arrow projectile 70. In this way, the first and second elastic launching elements 22, 24 do not interfere with each other when retracting, nor cause a rotational pull on the toy arrow projectile 70 when moving forward.

When the toy arrow projectile 70 is loaded, the pair of hook elements 71, 72 vertically engage the first and second elastic launching elements 22, 24, such that the pair of hook elements 71, 72 are aligned along a vertical axis. The distance between the pair of hook elements 71, 72 is substantially the same as the distance between the first and second elastic launching elements 22, 24, such that when the pair of hooks 71, 72engage the first and second elastic launching elements 22, 24 they do not alter the position and/or distance between the first and second elastic launching elements 22, 24. This enables the toy arrow projectile 70 to draw the first and second elastic launching elements 22, 24 rearwardly along parallel axes.

When drawing the first and second elastic launching elements 22, 24 with the toy arrow projectile 70 the toy arrow projectile exerts a force along a vertical axis 78 that is orthogonal to the first and second elastic launching elements 22, 24 and a force along a horizontal axis 80 that is parallel to the first and second elastic launching elements 22, 24. Accordingly, when the toy arrow projectile 70 is released, a reciprocal vertical and horizontal force is exerted onto the toy arrow projectile 70, which stabilizes the toy arrow projectile 70 along a linear trajectory, minimizing any rotational force or pull created thereby or exerted thereon by the first and second elastic launching elements 22, 24.

The left wing 12 defines a left body 12L including an outer end 28L, an inner end 30L, an upper surface 32L, a lower surface 34L opposite the upper surface 32L, a distal side 36L, a proximal side 38L, and an inner side 40L. The right wing 16 defines a right body 16R including an outer end 28R, an inner end 30R, an upper surface 32R, a lower surface 34R opposite the upper surface 32R, a distal side 36R, a proximal side 38R, and an inner side 40R. The central region 20 connects the left wing 12 to the right wing 16. The left wing 12 and the right wing 16 are symmetrical about the central region 20. The first elastic launching element 22 and the second elastic launching element 24 extend along the distal side 36L of the left body 12L and the distal side 36R of the right body 16R. In embodiments, the proximal side 38L of the left body 12L and the proximal side 38R of the right body 16R include one or more fasteners 39 for removably receiving toy arrow projectiles, as shown in FIGS. 6A-6C.

The left elastic support 14 comprises a left exterior post 14E disposed on the outer end 28L of left body 12L and a right interior post disposed 14I on the inner end 30L of the left body 12L. The left exterior post 14E and the left interior post 141 extend substantially orthogonally upwardly from the upper surface 32L of the left body 12L.

The right elastic support 18 comprises a right exterior post 18E disposed on the outer end 28R of right body 16R and a right interior post 18I disposed on the inner end 30R of the right body 16R. The right exterior post 18E and the right interior post 181 extend substantially orthogonally upwardly from the upper surface 32R of the right body 16R. The left exterior post 14E and the right exterior post 18E are symmetrical about the central region 20. The left interior post 141 and the right interior post181 are symmetrical about the central region 20.

The first elastic launching element 22 and the second elastic launching element 24 are coplanar and extend substantially parallel relative to each other above the central region 20. In this way, the first and second elastic launching elements 22, 24 may pivot and stretch in concert. The first elastic launching element 22 comprises a first end 22F and a second end22S. The second elastic launching element 24 comprises a first end 24F and a second end 24S. The first elastic launching element 22 and the second elastic launching element 24 are anchored to the left exterior post14E and the right exterior post 18E. In embodiments, the first end 22F of the first elastic launching element 22 and the first end 24F of the second elastic launching element 24 are attached within the left exterior post 14E. The second end 22S of the first elastic launching element 22 and the second end 24S of the second elastic launching element 24 are attached within the right exterior post 18E. In this way, the first ends 22F, 24F are anchored to the left exterior post 14E and the second ends 22S, 24S are anchored to the right exterior post 18E.

Referring now to FIGS. 7-20, in embodiments of the present disclosure, the toy projectile launching assembly 100 comprises a platform defined by a rigid shallow "V-shaped" structure with a flat base portion, the flat base has an upper U surface and a lower L surface. The platform includes a rigid left extension 112 having a rigid left elastic support 114E, a rigid right extension 116 having a rigid right elastic support 118E, and a rigid central region 120 disposed between the left extension 112 and the right extension 116. The platform further includes an interior left elastic support 114I and an interior right elastic support 118I situated between the rigid exterior left elastic support 114E and the rigid exterior right elastic support 118E, a first elastic launching element 122 extending continuously from the left elastic support 114E to the right elastic support 118E, a second elastic launching element 124 extending continuously from the left elastic support 114E to the right elastic support 118E, a handle 156 attached to the lower L surface at the flat base, an arm support 158 structure having a left side and right side that extends downwardly and rearwardly from the platform, and an arm support strap 162 attached to the left side and right side of the arm support 158 structure.

Figure 7:
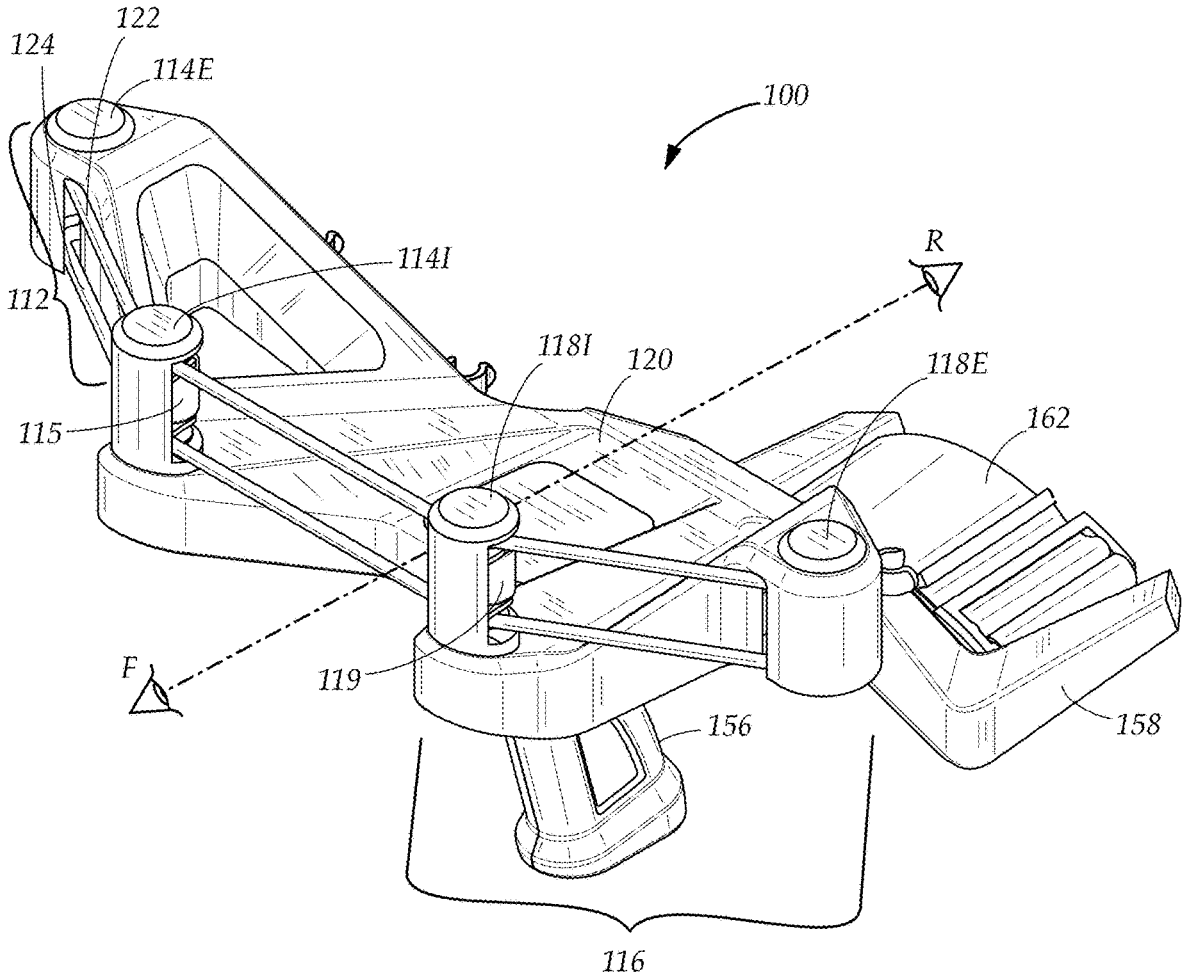
FIG. 7 is a perspective view of an improved toy projectile launching assembly 100 according to another embodiment of the present disclosure.
Figure 8:
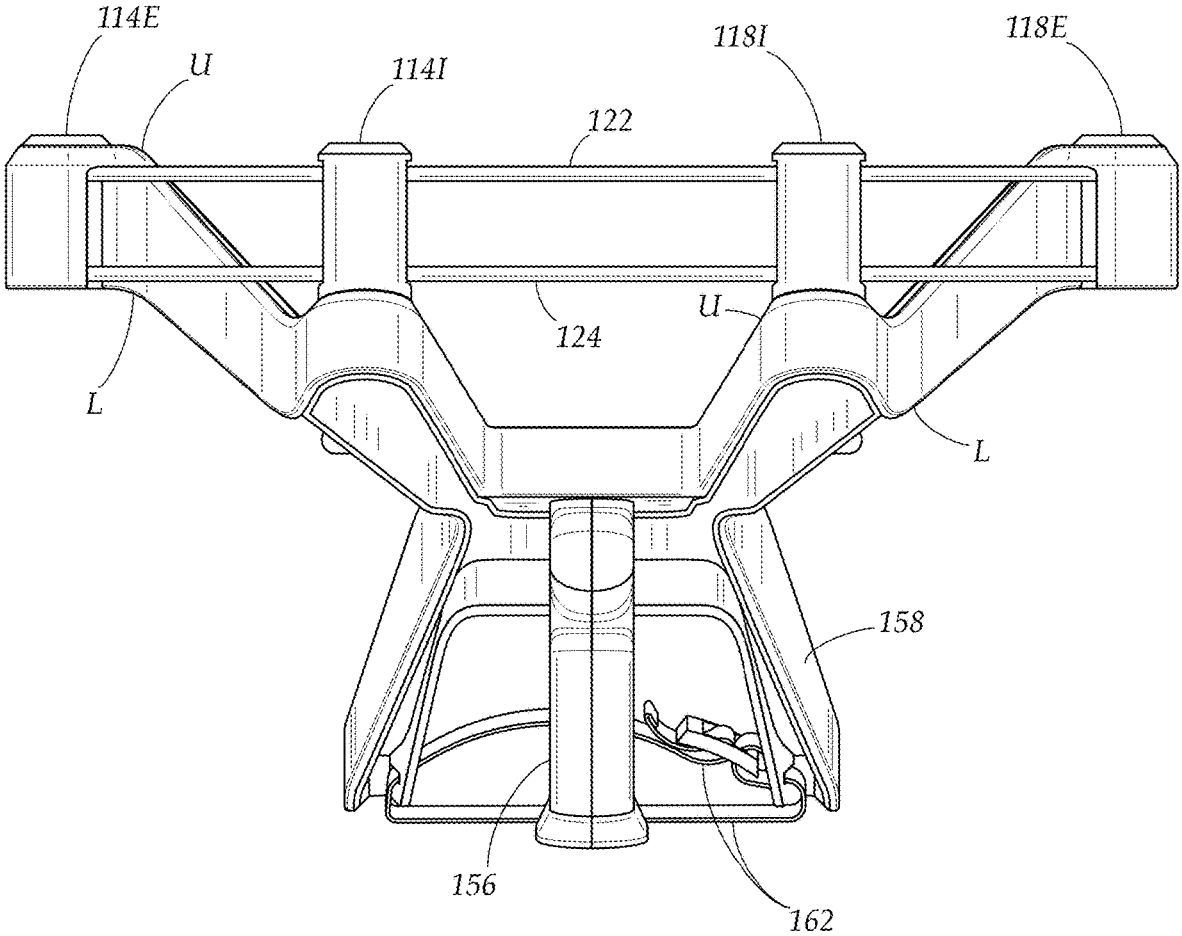
FIG. 8 is a front side view of the toy projectile launching assembly of FIG. 7.

The platform's rigid shallow "V-shaped" structure with a flat base portion may be envisioned in FIGS. 7 and 8 when viewed from the front F view or rear R view along the virtual F-R "eye" line. The flat base portion on the upper U surface is below the elastics 122, 124 in the central region 120. The region between the elastics 122, 124, vertically, and between the interior left elastic support 114I and the interior right elastic support 118I, horizontally, define the launch zone or window. The launch zone or window is where the assembly receives one or more projectiles such as shown in related launcher 10 in FIG. 6B. The flat base on the lower L surface locates a point of attachment with the handle 156.

The first elastic launching element 122 and the second elastic launching element 124 may each be removably attached to the rigid left elastic support 114E and the rigid right elastic support 118E.

Both ends of the first elastic launching element 122 and both ends of the second elastic launching element 124 may each be removably attached to two different removable brackets 125 situated within and attached to the lower L surface side of the rigid left elastic support 114E and the rigid right elastic support 118E.

Both ends of the first elastic launching element 122 and both ends of the second elastic launching element 124 may include a sub-assembly including a mated double-nippled bead and hollow elastic combination configured for attaching the launching elements 122, 124 to the removable bracket through retention slots 129.

The interior left elastic support 114I and an interior right elastic support 118I may each include an axle-roller assembly 115, 119 to accommodate freely reversible stretch, bend, run, or roll of the first and second elastic launching elements 122,124, about the roller-axle subassembly, and to reduce frictional wear of the first and second elastic launching elements 122, 124 during launching of a projectile.

Each axle-roller assembly 115, 119 may be reversibly attached to the interior left elastic support 114I and an interior right elastic support 118I.

Each axle-roller assembly 115, 119 may be permanently attached to the interior left elastic support 114I and an interior right elastic support 118I.

The handle 156 may be, for example, reversibly attachable-detactable to the lower L surface of the platform and extends substantially orthogonally downwardly from the lower L surface of the central region 120.

The handle 156 may be, for example, permanently attached to the lower L surface to the platform.

The arm support strap 162 may include, for example, a clasp 165 to adjust the tension of the strap 162 and the resulting comfort and stability to an operator.

The both ends of the first elastic launching element 122 and both ends of the second elastic launching element 124 may be, for example, each removably attached to a removable bracket 125 situated within a cavity and attached to the lower L surface side of the rigid left elastic support 114E and the rigid right elastic support 118E with knots of the elastic situated in the retention slots 129.

The first elastic launching element 122 and the second elastic launching element 124 may be, for example, coplanar and extend substantially parallel relative to each other above the central region 120.

The rear edges of the platform may include, for example, one or more fasteners, such as a press-fit or snap-in-place fastener, for removably receiving and holding one or more toy projectiles.

In embodiments, the handle 156 may be, for example, a pistol grip.

In embodiments, the disclosure provides a toy projectile launching assembly 100 that may be manufactured or sold without selected consumables or wear-and-tear items such as the elastic elements or projectiles comprising a platform defined by a rigid shallow "V-shaped" structure with a flat base portion, the flat base has an upper U surface and a lower L surface. The platform includes a rigid left extension 112 having a rigid left elastic support 114E, a rigid right extension 116 having a rigid right elastic support 118E, and a rigid central region 120 disposed between the left extension 112 and the right extension 116. The platform further includes an interior left elastic support 114I and an interior right elastic support 118I situated between the rigid exterior left elastic support 114E, and the rigid exterior right elastic support 118E, a handle 156 attached to the lower L surface at the flat base, an arm support 158 structure having a left side and a right side that extends downwardly and rearwardly from the platform, and an arm support strap 162 attached to the left side and right side of the arm support 158 structure.

In embodiments, the toy projectile launching assembly 100 may further include selected consumables, for example, a first upper elastic launching element 122 (i.e., an elastic) extending continuously from the upper left elastic support 114E, through the upper interior left elastic support 114I and the upper interior right elastic support 118I, and to the upper right elastic support 118E, and a lower second elastic launching element 124 extending continuously from the lower left elastic support 114E, through the lower interior left elastic support 114I and the lower interior right elastic support 118I, and to the lower right elastic support 118E.

In embodiments, the disclosure provides a method of making the toy projectile launching assembly having a "V-shaped" platform, comprising injection molding a suitable resin into a suitably configured mold to form the platform having the rigid shallow "V-shaped" structure having the flat base portion, attaching components to the platform including a roller-axle subassembly joined to the interior left elastic support 114I and the interior right elastic support 118I, a substantially orthogonally oriented handle to the lower surface of the platform, an adjustable arm support strap between the sides of the arm support, and one or more projectile fasteners. In embodiments, the method further comprises assembling components and attaching the assembled components to the platform including threading each end of a first elastic launching element 122 through the upper left elastic support 114I and the upper interior right elastic support 118I and attaching the threaded ends to the upper attachment points of the left and right removable brackets, threading each end of a second elastic launching element 124 through lower left elastic support 114I and the lower interior right elastic support 118I and attaching the threaded ends to the lower attachment points of the left and right removable brackets, and inserting the left and right removable brackets having the threaded and attached elastic elements into their respective rigid exterior left elastic support 114E cavity, and the rigid exterior right elastic support 118E cavity.

Referring to the FIGS. 7-20, simultaneously, the toy projectile launching assembly 100 structure shown and described in FIGS. 7-20 is most notably distinguished from the toy projectile launching assembly shown and described in FIGS. 1-6, by having its elastic members 122, 124 associated with and attached to both the upper surface U and lower surface L of the assembly 100. The upper surface U and lower surface L of the assembly 100 are opposite or opposing surfaces of the rigid platform. This disclosed improved disposition of elastic members 122, 124 provides advantages to the manufacture of the assembly, replacement or repair of broken or damaged elastic members, and in-use advantages that prevent rotational pull of the platform during the launch of projectiles that provides better aim of the launcher and better accuracy of the launched of projectiles.

FIG. 7 illustrates a further modified toy projectile launching or launcher assembly 100 configured to launch toy projectiles. The toy projectile launcher assembly 100 includes a rigid platform defined by a rigid and shallow "V-shaped" structure (viewed from the front-eye "F" or rear-eye "R") having a flat base or bottom, including a rigid left extension 112 having a rigid left elastic support 114E, a rigid right extension 116 having a rigid right elastic support 118E, a rigid central region 120 disposed between the left extension 112 and the right extension 116, a first elastic launching element 122 extending continuously from the left elastic support 114E to the right elastic support 118E, and a second elastic launching element 124 extending continuously from the left elastic support 114E to the right elastic support 118E. The first and second elastic launching elements 122, 124 are configured to separately attach to their respective left and right elastic supports 114E, 118E, and when in-use stretch rearwardly over the central region 120 to launch a toy projectile. The first and second elastic launching elements 122 (upper), 124 (lower) ("elastics") are also separately configured to each thread through the interior left elastic support 114I and the interior right elastic support 118I. The interior left elastic support 114I and the interior right elastic support 118I, are configured to permit the first and second elastic launching elements 122, 124 to freely reversibly stretch and bend around the roller-axle assemblies 115, 119 fastened within the interior left elastic support 114I and the interior right elastic support 118I. Also shown is handle 156, arm support 158, and arm support strap 162.

FIG. 8 is a front view F of the toy projectile launching assembly of FIG. 7. The "V-shaped" flat bottom platform has an upper U surface and a lower L surface. The rigid left elastic support 114E and the rigid right elastic support 118E may be reversibly fastened to the lower L surface of the platform, whereas the interior left elastic support 114I and the interior right elastic support 118I may be irreversibly attached, such as fastened or molded to the upper U surface of the platform. The reversible fastening of the supports 114E and 118E to the lower L surface of the platform permits rapid installation of the elastics during manufacture or assembly, or for rapid repair and replacement of a broken or damaged elastic by an owner-operator. Rapid installation or replacement of the elastics also permits upgrading or downgrading the draw loading strength of the launcher such as for changes in age, strength, or skill level. Also shown is the upper elastic 122, the lower elastic 124, handle 156, arm support 158, and arm support strap 162.

Figure 9:
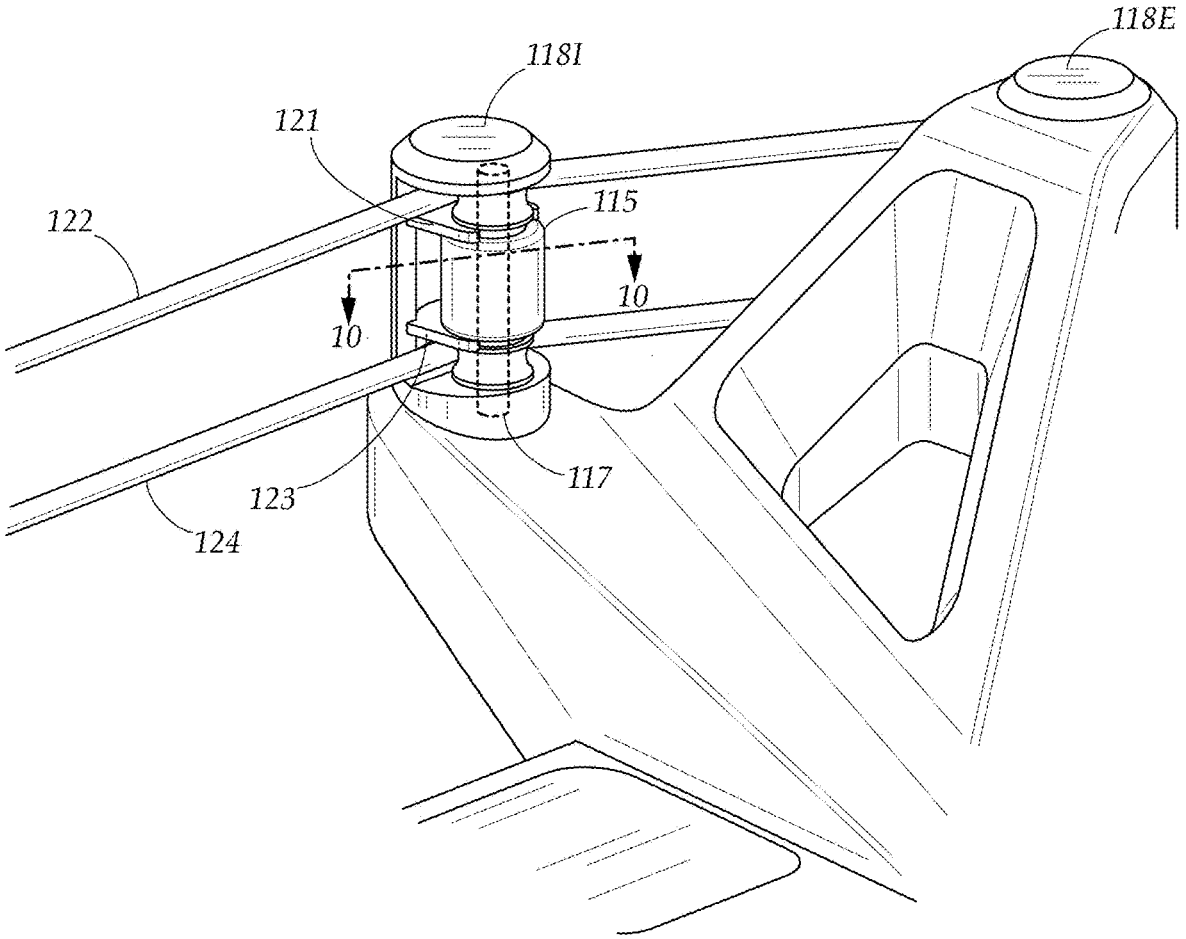
FIG. 9 is an enlarged perspective view of a portion of the toy projectile launching assembly of FIG. 7 emphasizing the right-side proximal and distal elastic supports.

FIG. 9 is an enlarged perspective rear-eye R view of a portion of the toy projectile launching assembly of FIG. 7 emphasizing the right-side proximal and right-side distal elastic supports including the interior right-side elastic support 118I and the right-side elastic support 118E. Also shown are the roller-axle assembly including the right roller 115 and the hidden axle 117, a portion of the upper elastic 122 and the lower elastic 124, arm support 158, and arm support strap 162. Both the upper elastic 122 and the lower elastic 124 may be separated from each other and confined to a parallel track path by, for example, an upper spacer bracket 121 and a lower spacer bracket 123. The brackets 121 and 123 may be, for example, open toward the rear-view R to allow press-fit installation or replacement of the roller-axle assembly in the interior right-side elastic support 118I, the interior left elastic support 114I, or both. Alternatively, the brackets 121 and 123 may be, for example, closed toward the rear-view R to prohibit the roller-axle 115, 117 assembly from inadvertently releasing from a fixed lateral position in either of the interior right-side elastic support 118I, the interior left elastic support 114I, or both. In a closed bracket configuration, the roller-axle 115, 117 assembly may be, for example, molded in-place, spring loaded during initial construction, or both.

Figure 10:
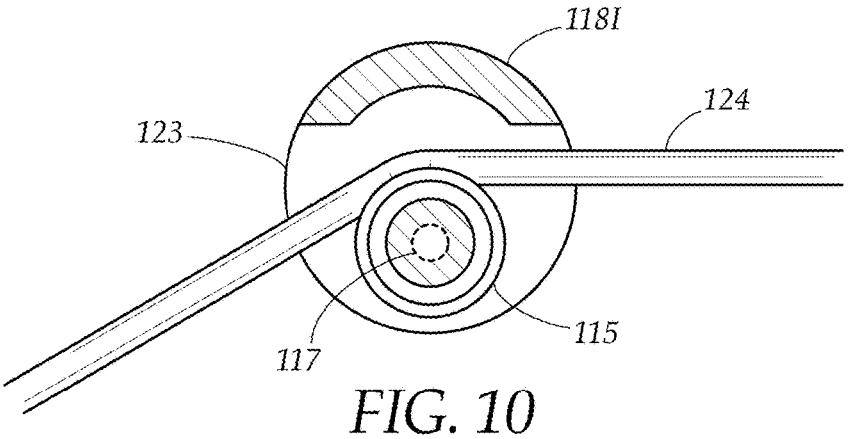
FIG. 10 is an enlarged cross section view of a portion of the interior right-side elastic support 118I of FIG. 9.

Although the interior left elastic support 114I is not shown in detail in FIG. 9 or FIG. 10, one of skill recognizes by symmetry a mirror-image identical structure for the support 114I.

FIG. 10 is an enlarged cross-section view of the right-side elastic support 118I and roller-axle assembly showing the roller 115 and axle 117 or post, lower bracket 123 (closed configuration), and a portion of the lower elastic 124 at section 10-10 of FIG. 9.

Figure 11:
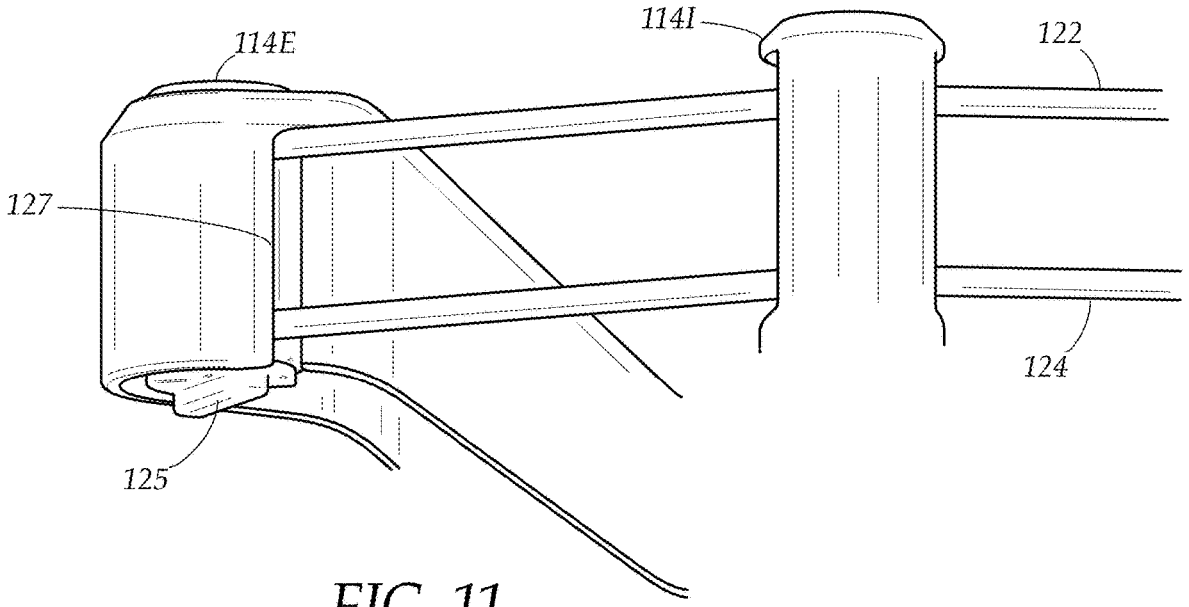
FIG. 11 is an enlarged frontal perspective view of a portion of the toy projectile launching assembly emphasizing the assembled left-side distal elastic support 114E including a twist-lock retention bracket 125 according to another embodiment of the present invention.

FIG. 11 is an enlarged perspective front view F of a portion of the toy projectile launching assembly emphasizing the assembled rigid left elastic support 114E and the rigid interior left elastic support 114I. FIG. 11 is an enlarged frontal perspective view of a portion of the toy projectile launching assembly emphasizing the assembled left-side proximal 114E support and left-side distal elastic 114I support. The lower and upper elastics 124, 122, respectively, are separately threaded through the roller-axle assembly (not shown) in the left-side distal elastic 114I support. The lower and upper elastics 124, 122, are separately anchored to a twist-lock elastic retention-bracket 125 (hidden) that is inserted into position from below and locked into position from below. The assembled left-side distal elastic 114E support has a vertical slot 127 in the side-wall surface to accommodate the pass-through of the lower and upper elastics 124, 122. The assembled right-side proximal elastic 118E support is, by symmetry, similarly situated and constructed as described above for the distal elastic 114E support.

Figure 12:
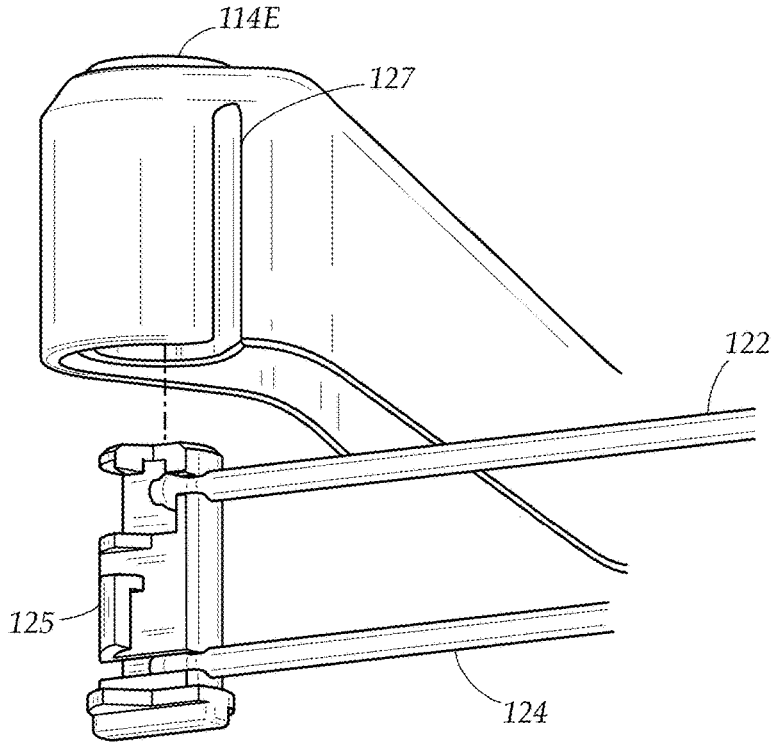
FIG. 12 is a portion of the enlarged perspective view of FIG. 11 emphasizing the assembled left-side distal elastic support 114E including the exploded twist-lock retention bracket 125.

FIG. 12 is a portion of the enlarged perspective view of FIG. 11 emphasizing the assembled left-side distal elastic support 114E including the exploded twist-lock retention bracket 125 (inserted from below or the lower L surface direction). Also shown are the elastics 122, 124 connected to the exploded twist-lock retention bracket 125 through the bead and elastic combinations discussed further in FIGS. 13 to 16.

Figure 13:
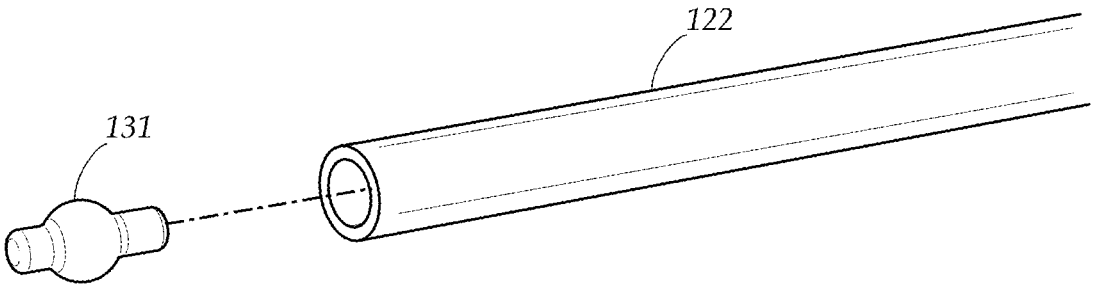
FIG. 13 is an exploded portion of the enlarged perspective view of a portion of the toy projectile launching assembly emphasizing an end of a hollow elastic 122 and a mating double-nippled bead 131 according to another embodiment of the present disclosure.

FIG. 13 is an exploded portion of the enlarged perspective view of a portion of the toy projectile launching subassembly emphasizing an end of a hollow elastic 122 and a mating double-nippled bead 131.

Figure 14:
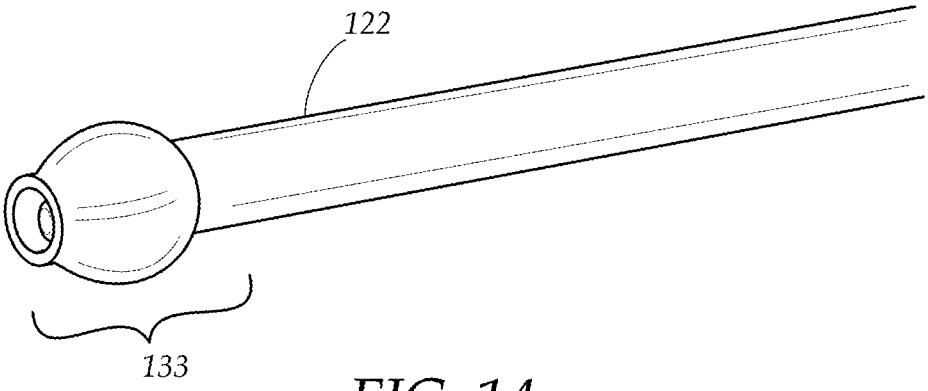
FIG. 14 is an enlarged perspective view of the combined components of FIG. 13 showing a bead and elastic combination 133.

FIG. 14 is an enlarged perspective view of the combined components of FIG. 13 showing the assembled bead and elastic combination 133.

Figure 15:
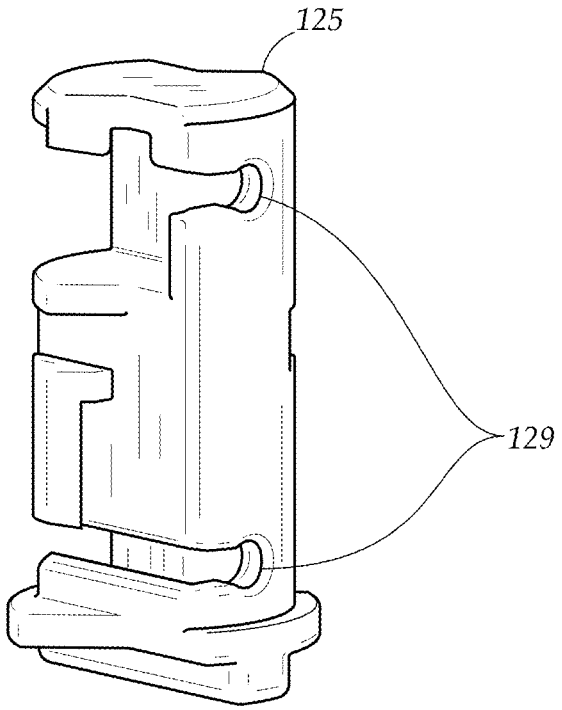
FIG. 15 is an enlarged perspective view of the twist-lock retention bracket 125 that inserts into the distal elastic support 114E shown in FIG. 12.

FIG. 15 is an enlarged perspective view of the twist-lock retention bracket 125 that inserts into the distal elastic support 114E shown in FIG. 12. The twist-lock retention bracket 125 includes retention slots 129 for receiving and retaining the assembled bead and elastic combination 133 shown in FIG. 14. Alternatively, the bracket 125 and slots 129 may receive and retain an elastic knot end (not shown).

Figure 16:
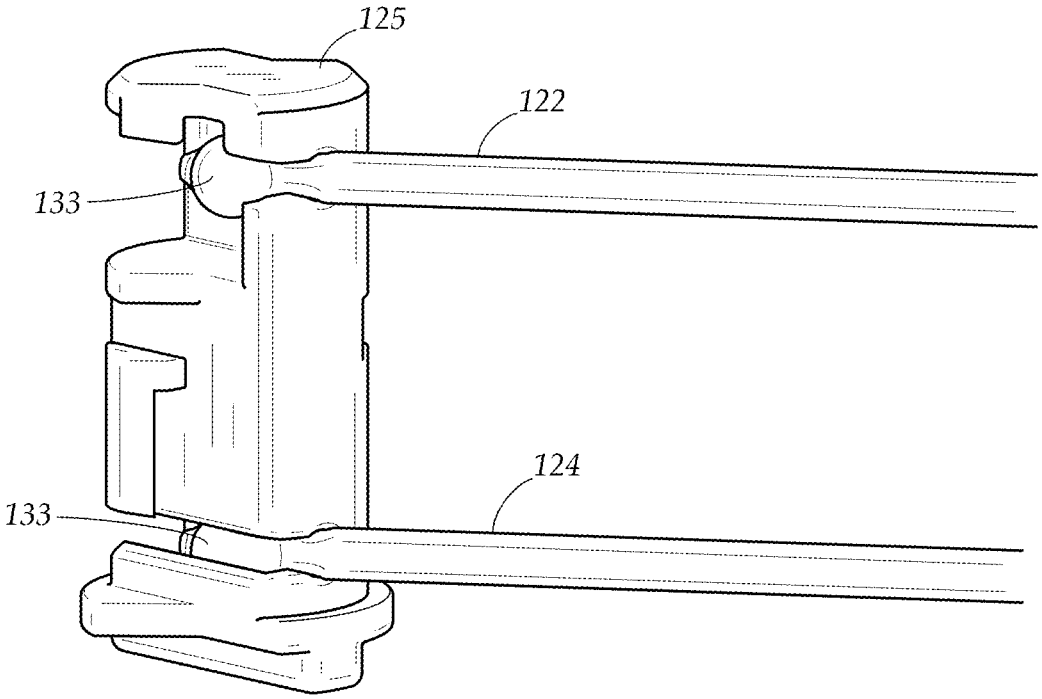
FIG. 16 is an enlarged perspective view of the distal elastic support insert shown in FIG. 12 showing the combined insert configured with the beaded elastic combination shown in FIG. 14.

FIG. 16 is an enlarged perspective view of the distal elastic support insert shown in FIG. 12 showing the combined insert configured with the beaded elastic combination 133 shown in FIG. 14. The combined insert configured with the beaded elastic combination 133 shown in FIG. 14 is inserted into the cavity of the left-side distal elastic support 114E from the lower side and surface L of the platform. By symmetry, a combined insert identically configured with a beaded elastic combination 133 shown in FIG. 14 is also inserted into a cavity of the right-side distal elastic support 118E from the lower surface L of the assembly.

Figure 17:
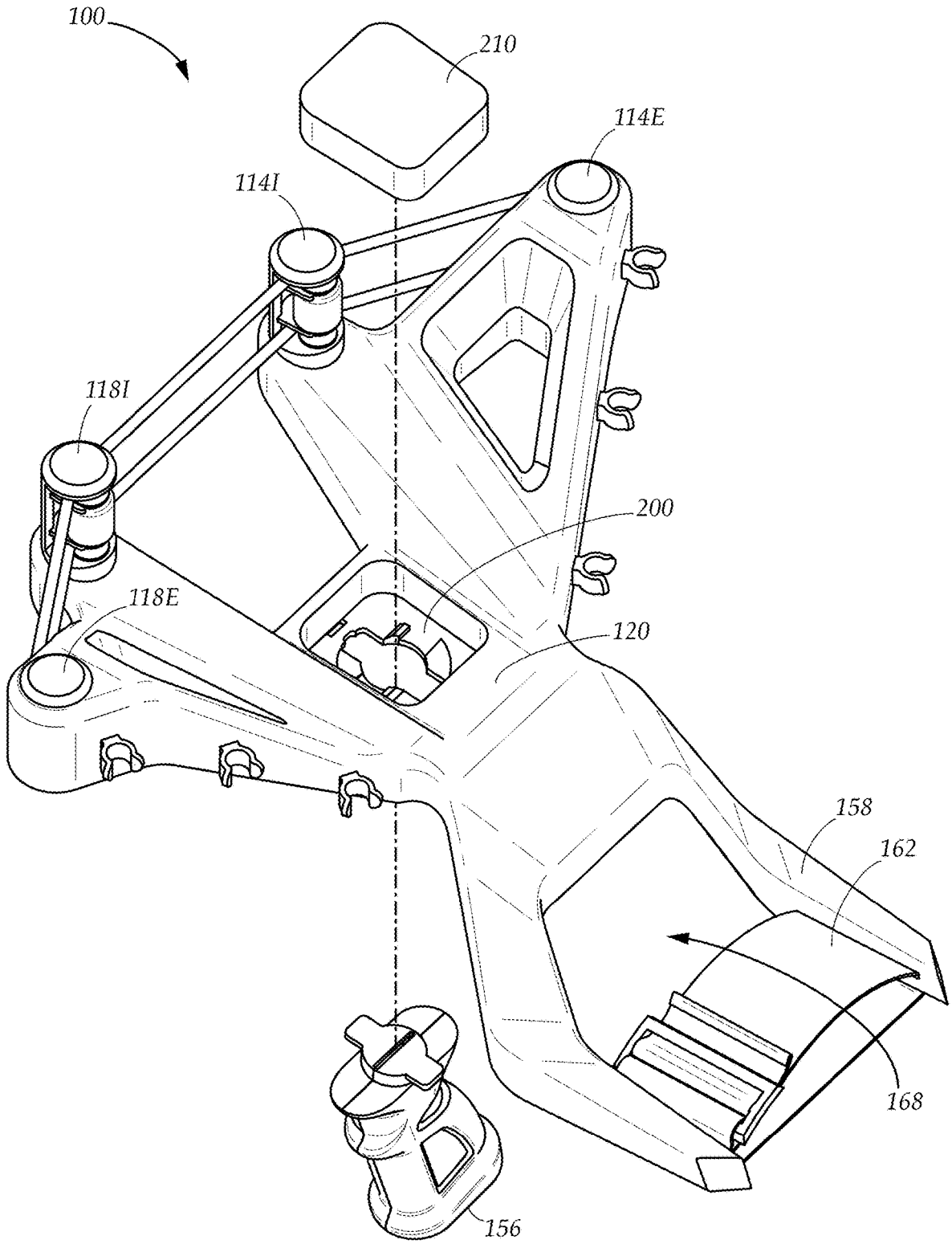
FIG. 17 is a perspective view of the toy launcher assembly showing a partial exploded view of a compartment 200 having a cover 210 in the central region that permits the handle 156 to be removably attached to the rigid "V-shaped" frame 100 according to another embodiment of the present disclosure.
Figure 18:
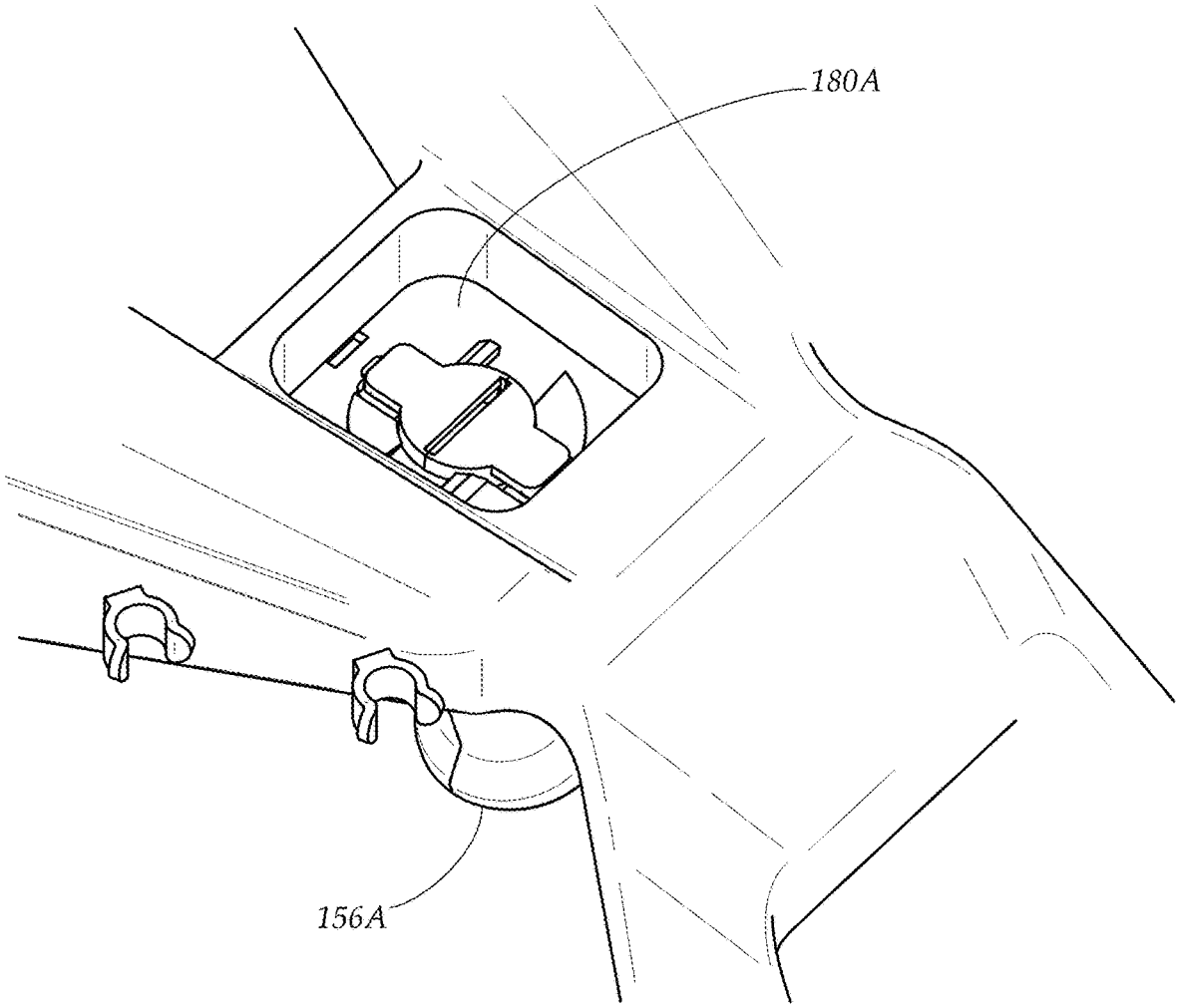
FIG. 18 is a magnified perspective view of the partial assembly of the handle 156 engaged to the rigid "V-shaped" frame 100 of FIG. 17 through an aperture with the cover 210 removed for clarity.
Figure 19:
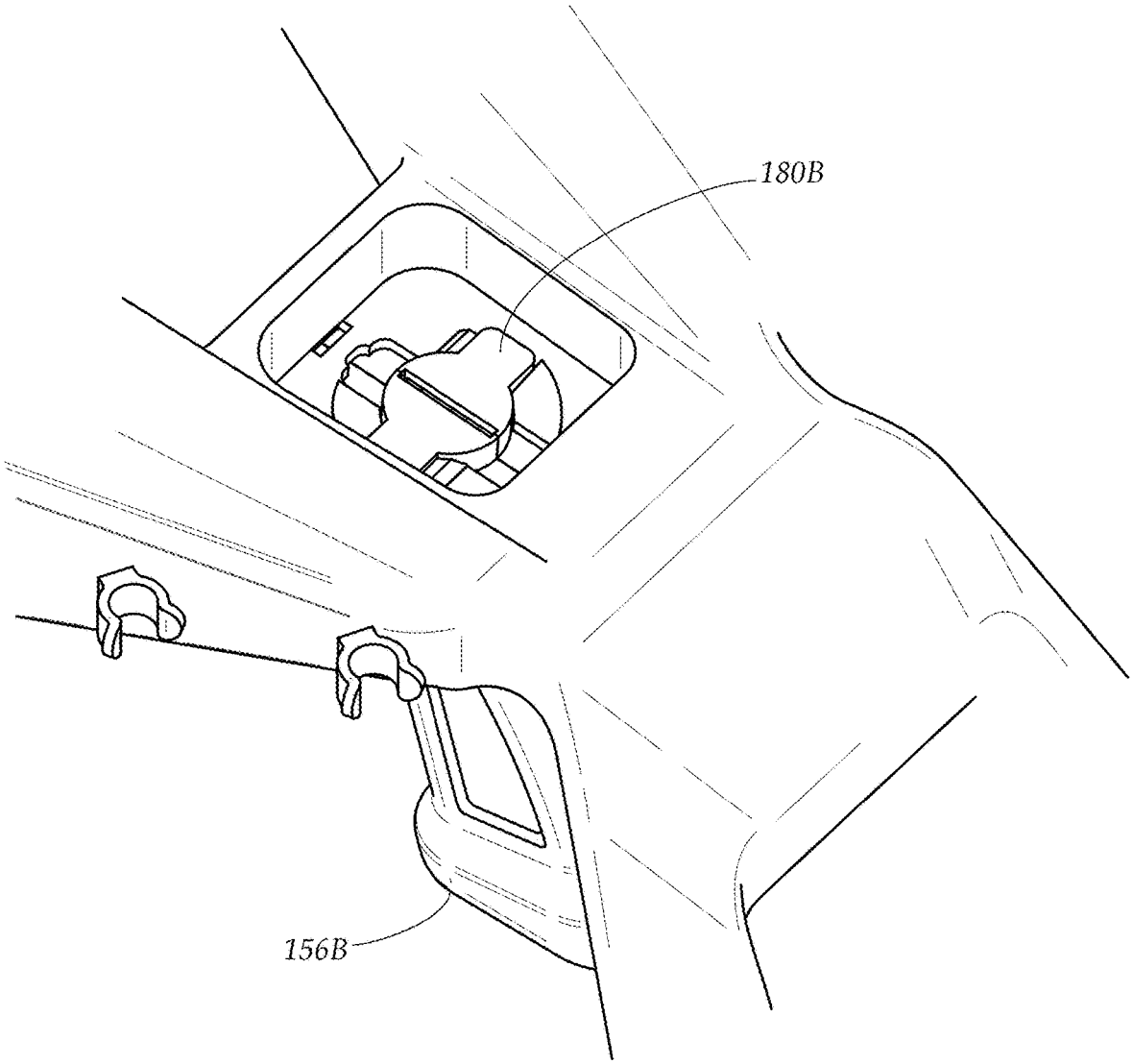
FIG. 19 is a magnified perspective view of the partial assembly of the handle 156 attached and locked into position with the rigid "V-shaped" frame 100 of FIG. 17 with the cover 210 removed for clarity.

FIG. 17 is a perspective view of the "V-shaped" toy launcher assembly 100 from the rear R and above, showing a partial exploded view of a compartment or cavity 200 having a cover 210 in the rigid central region 120 that permits the handle 156 to be removably attached to the rigid "V-shaped" frame 100. In assembly, the removable handle 156 is positioned at a 90 degree vertical angle to insert the handle 156 into the cavity 200 having a twist-lock mating surface with the unfastened handle 156A position 180A as shown in FIG. 18. Then the inserted handle 156 is rotated 90 degrees (e.g., clockwise) to lock the handle 156B in proper forward facing orientation with the twist-lock mating surface 180B as shown in FIG. 19. Also shown for reference are previously illustrated members: opening 168 between the arm support 158, below which an operator's arm is positioned to engage the correctly oriented handle 156 and the arm support strap 162; the exterior rigid elastic support 114E; the interior elastic support 114I; the rigid elastic support 118E; and the interior elastic support 118I. In alternative embodiments, the handle 156 may be attached to the platform by any suitable attachment method such as molding the handle 156 to the underside (i.e., the lower L surface side) of the platform while molding the platform (i.e., an integral handle generation), plastic or ultrasonic welding the handle 156 to the underside of the platform, attaching the handle 156 to the underside of the platform with a suitable adhesive such as an engineering grade plastic such as an epoxy and like durable adhesives or sealants, and like alternative handle generation or attachment methods.

Suitable plastics for rigid portions of the platform or piece-parts may include, for example, standard thermoplastics, engineering plastics, and high-performance thermoplastics. Semi-crystalline plastics are preferred for their properties (e.g., opaque, flexible, and chemically resistant). Amorphous plastics are less preferred for their properties (e.g., transparent, brittle, and not chemically resistant).

Semi-crystalline plastics that are rigid but have a limited amount of flexibility are preferred. A limited amount of flexibility means, for example, that when the launcher engages and launches a projectile, the rigid platform or piece-parts will not significantly deform or flex over time, including actual launcher use and ambient storage time, to interfere with the launcher structure and launcher function. Suitable engineering grade plastics for rigid portions of the platform or piece-parts may include, for example, polyamides, polycarbonates, poly (methyl methacrylates), ABS, and like plastics.

Suitable method for forming plastics for rigid portions of the platform or piece-parts may include, for example, injection molding, vacuum sheet molding, emboss or stamp molding, and like methods.

FIG. 18 is a magnified perspective view of the partial assembly of the handle 156 engaged to but unattached to the underside (lower side L) of the platform of FIG. 17 through an aperture with the cover 210 removed for position verification and clarity.

FIG. 19 is a magnified perspective view of the partial assembly of the handle 156 attached and locked into position with the platform of FIG. 17 with the cover 210 removed for position verification and clarity. When the handle 156 is properly secured in the twist-lock mating surface the cover 210 may be press-fit into a proper covered positioned as shown in FIG. 7.

Figure 20:
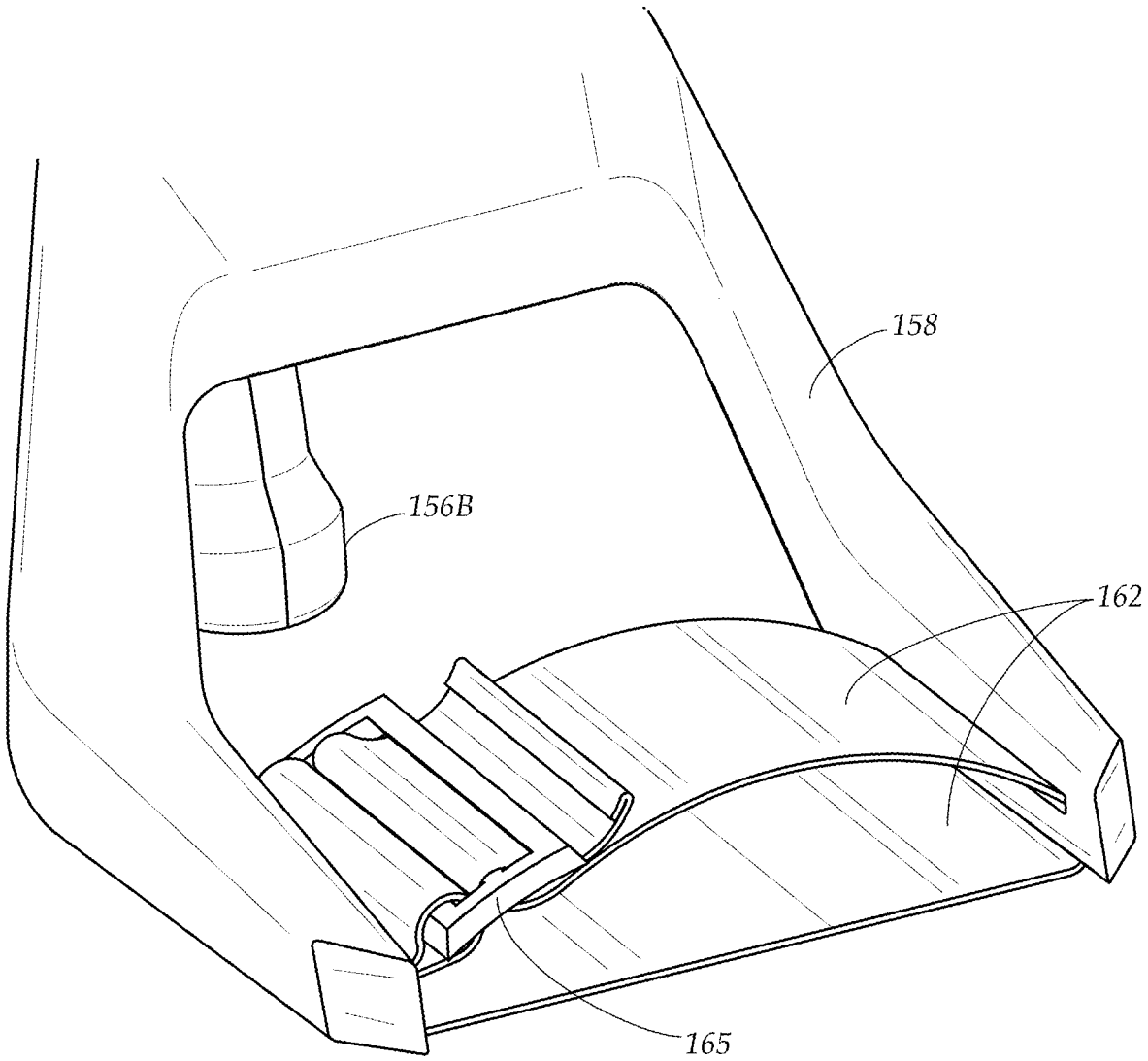
FIG. 20 is a magnified rear perspective view of the arm support 158 having an upper and lower portion, and an optional clasp for tightening or loosening the tension in the arm support band (such as an elastic flat band).
Figure 21:
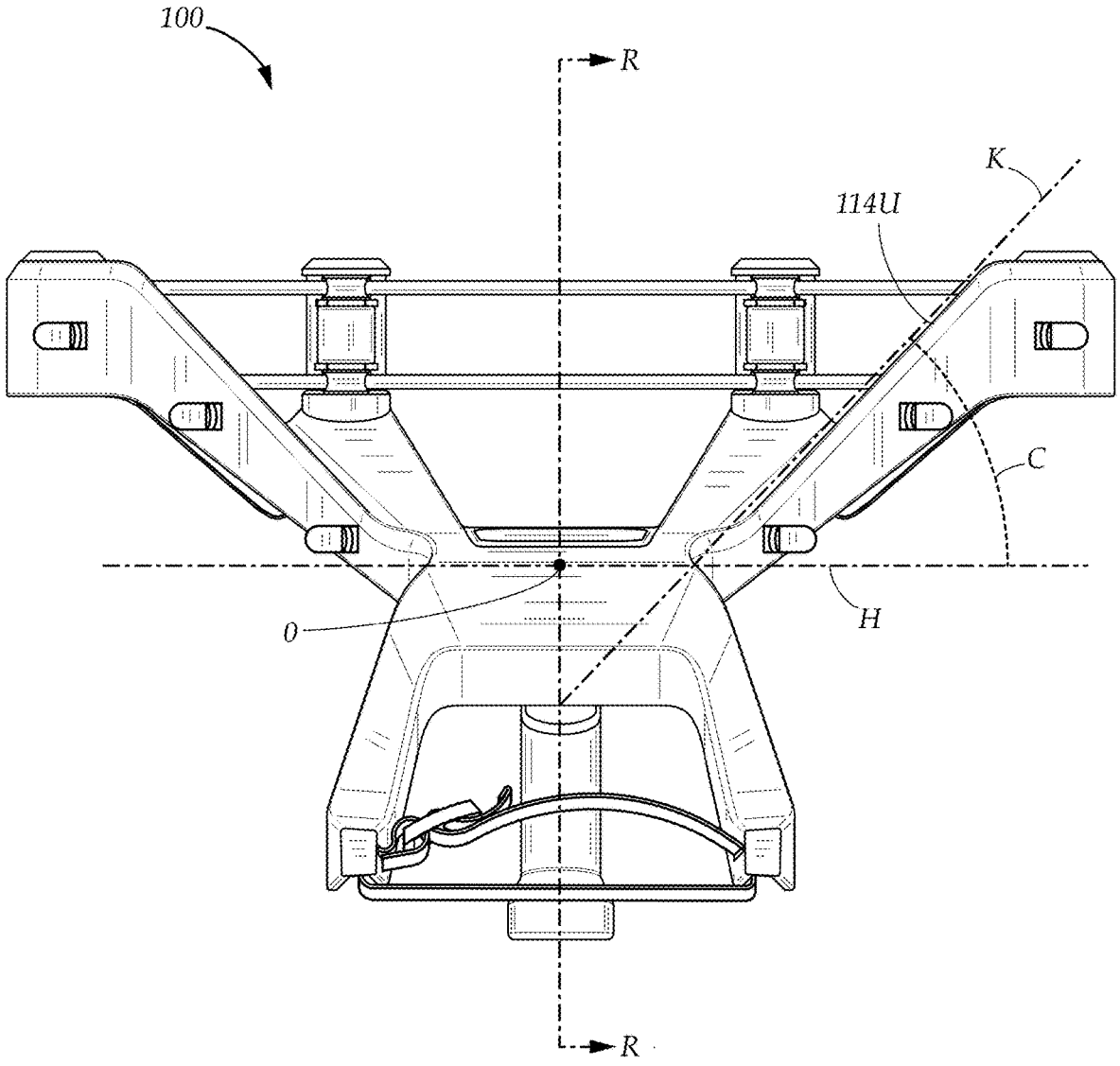
FIG. 21 is a rear (R) view which more clearly shows a cross-section line "R-R" and rearward slopping and downward slopping aspects of the shaped rigid platform of the disclosed toy projectile launching assembly.
Figure 22:
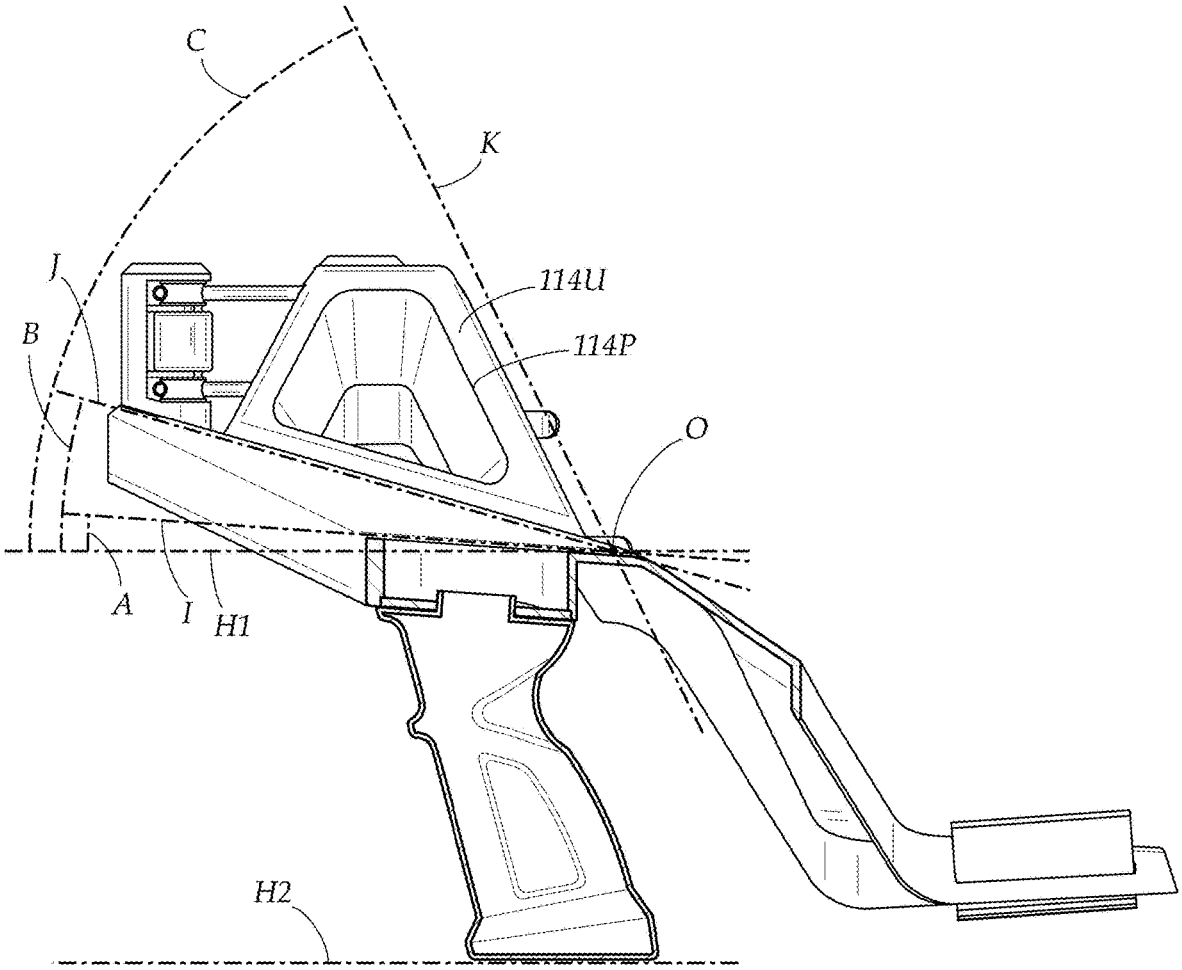
FIG. 22 is a cross-sectional view (at section R-R in FIG. 21) which more clearly shows angle and arc aspects of the shaped rigid platform of the disclosed toy projectile launching assembly.

FIG. 20 is a magnified rear R perspective view of the arm support 158 area of the platform, an arm support strap or band 162 optionally having an upper and lower portion, and an optional clasp 165 for tightening or loosening the tension in the arm support band (such as an elastic flat band). Also shown is a portion of the forward facing handle 156. FIG. 21 is a rear (R) view which more clearly shows a cross-section line "R-R", a reference elevational horizontal line (H) having 0 degrees slope, a reference origin (O) and collocated vertex for illustrating rays and angle/arc measurements such as: angle C situated between ray K and originating from the elevational horizontal line (H). Ray K coincides with the downward slope of the upper surface of the rigid surface 114 (114U). FIG. 22 is a cross-sectional view (at section R-R in FIG. 21) which more clearly shows: the reference origin (O); the parallel elevational horizontal lines (H1, H2) both having 0 degrees and are parallel; a ray "I" defining angle or arc "A" between the reference horizontal line "H1" and the ray "I"; a ray "J" defining angle or arc "B" between the reference horizontal line "H1" and the ray "J"; a ray "K" defining angle or arc "C" between the reference horizontal line "H1" and the ray "K"; and the downward slopping of upper surface 114U which coincides with ray "K". Also, more clearly visible in this new view is an aperture 114P passing-through the upper surface 114U. The lower surface aperture 114L pass-through is not visible in this view. Accordance with the present disclose, in embodiments, there are disclosed:

A toy projectile launching assembly for launching toy projectiles, comprising: a rigid platform defined by a shallow "V-shaped" structure; the rigid platform having an upper surface and a lower surface; the rigid platform having a flat base portion; the rigid platform having a left rigid extension and a right rigid extension, both left and right rigid extensions extend upwardly above the upper surface of the flat base portion and the edges of the flat base portion, wherein the left rigid extension and the right rigid extension form the respective upward left and right legs of the shallow "V-shaped" structure, and the flat base portion is situated at the vertex of the shallow "V-shaped" structure; the distal end of the rigid left extension having a rigid exterior left elastic support, the distal end of the rigid right extension having a rigid exterior right elastic support, wherein the rigid exterior left elastic support and the rigid exterior right elastic support are attached to the rigid platform from below the upper surface; the rigid platform having a rigid interior left elastic support and a rigid interior right elastic support that are situated between the rigid exterior left elastic support and the rigid exterior right elastic support, wherein the rigid interior left elastic support and the rigid interior right elastic support are attached to the rigid platform above the upper surface; the rigid platform having an upper first elastic launching element that extends continuously from the exterior left elastic support, through the interior left elastic support and the interior right elastic support, then to the right elastic support, and the upper first elastic launching element is attached at one end to the left exterior elastic support and the other end to the right exterior elastic support; the rigid platform having a lower second elastic launching element, that is situated below the upper first elastic launching element, and the lower second elastic launching element extends continuously from the left elastic support, through the interior left elastic support and the interior right elastic support, then to the right elastic support, and the lower second elastic launching element is attached at one end to the left exterior elastic support and the other end to the right exterior elastic support; wherein the interior left elastic support and the interior right elastic support each include an axle-roller assembly to accommodate movement of the upper first and the lower second elastic launching elements about the roller-axle subassembly, and to reduce frictional wear of the upper first and lower second elastic launching elements when stretched and relaxed; the rigid platform having a pistol grip handle attached perpendicularly to the lower surface near the underside of the flat base portion and extending angularly rearwardly; the rigid platform having an arm support structure having a left side and a right side attached to the left side and the right side of the flat base, wherein the arm support extends downwardly and rearwardly from the rigid platform; the rigid platform having an arm support strap attached to the left side and the right side of the arm support structure; and wherein the rigid platform is a monolithic molded plastic. In other embodiments, there are disclosed aspects of the abovementioned toy projectile launching assembly, wherein: the flat base portion, when viewed in vertical cross-section, has a rearward slope angle from front-to-rear of the rigid platform of from about 0.1 degree to about 10 degrees; the upper surfaces near the interior left elastic support and the interior right elastic support, when viewed in vertical cross-section, have a rearward slope angle from front-to-rear of the rigid platform of from about 5 degrees to about 35 degrees; and the upper surfaces near the rigid exterior left elastic support and the rigid exterior right elastic support, when viewed from the rear, each have a downward slope angle of from about 30 degrees to about 80 degrees from the respective distal edges to proximal edges that are adjacent to the upper surfaces near the interior left elastic support and the interior right elastic support, and then abuts the flat base portion of the rigid platform defined near the vertex of the shallow "V-shaped" structure. In other embodiments, there are disclosed aspects of the abovementioned toy projectile launching assembly, wherein: the flat base portion, when viewed in vertical cross-section, has a rearward slope angle from front-to-rear of the rigid platform of from about 3 degrees to about 8 degrees; the upper surfaces near the interior left elastic support and the interior right elastic support, when viewed in vertical cross-section, have a rearward slope angle from front-to-rear of the rigid platform of from about 10 degrees to about 25 degrees; and the upper surfaces near the rigid exterior left elastic support and the rigid exterior right elastic support, when viewed from the rear, each have a downward slope angle of from about 40 degrees to about 70 degrees from the respective distal edges to proximal edges that are adjacent to the upper surfaces near the interior left elastic support and the interior right elastic support, and then abuts the flat base portion of the rigid platform defined near the vertex of the shallow "V-shaped" structure. In other embodiments, there are disclosed aspects of the abovementioned toy projectile launching assembly, further comprising at least one aperture passing through the upper and lower surfaces of each of the left and right rigid extensions to increase the overall structural strength and reduce the overall weight of the launching assembly. In other embodiments, there are disclosed aspects of the abovementioned toy projectile launching assembly, wherein: the underside of the assembly from beneath the interior left elastic support and the interior right elastic support to the rear of the rigid platform is hollow to increase the overall structural strength and reduce the overall weight of the launching assembly. In other embodiments, there are disclosed other alternative aspects of the abovementioned toy projectile launching assembly comprising: a rigid platform defined by a shallow "V-shaped" structure; the rigid platform having an upper surface and a lower surface; the rigid platform having a flat base portion; the rigid platform having a left rigid extension and a right rigid extension, both left and right rigid extensions extend upwardly above the upper surface of the flat base portion and the edges of the flat base portion, wherein the left rigid extension and the right rigid extension form the respective upward left and right legs of the shallow "V-shaped" structure, and the flat base portion is situated at the vertex of the shallow "V-shaped" structure; the distal end of the rigid left extension having a rigid exterior left elastic support, the distal end of the rigid right extension having a rigid exterior right elastic support, wherein the rigid exterior left elastic support and the rigid exterior right elastic support are attached to the rigid platform from below the upper surface; the rigid platform having a rigid interior left elastic support and a rigid interior right elastic support that are situated between the rigid exterior left elastic support and the rigid exterior right elastic support, wherein the rigid interior left elastic support and the rigid interior right elastic support are attached to the rigid platform above the upper surface; the rigid platform having an upper first elastic launching element that extends continuously from the exterior left elastic support, through the interior left elastic support and the interior right elastic support, then to the right elastic support, and the upper first elastic launching element is attached at one end to the left exterior elastic support and the other end to the right exterior elastic support; the rigid platform having a lower second elastic launching element, that is situated below the upper first elastic launching element, and the lower second elastic launching element extends continuously from the left elastic support, through the interior left elastic support and the interior right elastic support, then to the right elastic support, and the lower second elastic launching element is attached at one end to the left exterior elastic support and the other end to the right exterior elastic support; wherein the interior left elastic support and the interior right elastic support each include an axle-roller assembly to accommodate movement of the upper first and the lower second elastic launching elements about the roller-axle subassembly, and to reduce frictional wear of the upper first and lower second elastic launching elements when stretched and relaxed; the rigid platform having a pistol grip handle attached perpendicularly to the lower surface near the underside of the flat base portion and extending angularly rearwardly; the rigid platform having an arm support structure having a left side and a right side attached to the left side and the right side of the flat base, wherein the arm support extends downwardly and rearwardly from the rigid platform; the rigid platform having an arm support strap attached to the left side and the right side of the arm support structure; wherein the rigid platform is a monolithic molded plastic;

wherein the flat base portion, when viewed in vertical cross-section, has a rearward slope angle from front-to-rear of the rigid platform of from about 3 degrees to about 8 degrees; the upper surfaces near the interior left elastic support and the interior right elastic support, when viewed in vertical cross-section, have a rearward slope angle from front-to-rear of the rigid platform of from about 10 degrees to about 25 degrees; and the upper surfaces near the rigid exterior left elastic support and the rigid exterior right elastic support, when viewed from the rear, each have a downward slope angle of from about 40 degrees to about 70 degrees from the respective distal edges to proximal edges that are adjacent to the upper surfaces near the interior left elastic support and the interior right elastic support, and then abuts the flat base portion of the rigid platform defined near the vertex of the shallow "V-shaped" structure; at least one aperture passing through the upper and lower surfaces of each of the left and right rigid extensions to increase the overall structural strength and reduce the overall weight of the launching assembly; and wherein the underside of the assembly from beneath the interior left elastic support and the interior right elastic support to the rear of the rigid platform is hollow to increase the overall structural strength and reduce the overall weight of the launching assembly.

It is understood that when an element is referred hereinabove as being "on" another element, it may be directly on the other element or intervening elements may be present therebetween. In contrast, when an element is referred to as being "directly on" another element, there are no intervening elements present.

Moreover, any components or materials may be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" may encompass both an orientation of above and below. The device may be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a toy projectile launching assembly. The disclosure is illustrated by example in the drawing figures, and throughout the written description. It should be understood that numerous variations are possible, while adhering to the inventive concept. Such variations are contemplated as being a part of the present disclosure.

What is claimed is:

1. A toy projectile launching assembly for launching toy projectiles, comprising:

a platform defined by a rigid shallow "V-shaped" structure with a flat base portion, the flat base portion having an upper surface and a lower surface, including:

a rigid left extension having a rigid exterior left elastic support, a rigid right extension having a rigid exterior right elastic support, and a rigid central region defining the flat base portion disposed between the rigid left extension and the rigid right extension;

an interior left elastic support and an interior right elastic support situated between the rigid exterior left elastic support, and the rigid exterior right elastic support;

an upper first elastic launching element extending continuously from, and attached to, the upper portion of the left elastic support, then through the upper portion of the interior left elastic support and the upper portion of the interior right elastic support, and to the upper portion of the right elastic support; and a lower second elastic launching element extending continuously from, and attached to, the lower portion of the left elastic support, then through the lower portion of the interior left elastic support and the lower portion of the interior right elastic support, and to the lower portion of the right elastic support;

wherein the left end of the upper first elastic launching element and the left end of the lower second elastic launching element are each removably attached to a first removable bracket situated within a cavity in the rigid exterior left elastic support, the right end of the upper first elastic launching element and the right end of the lower second elastic launching element are each removably attached to a second removable bracket situated within a cavity in the rigid exterior right elastic support, and each of the removable brackets is attached to the lower surface side of the rigid left elastic support and the rigid right elastic support, with the ends of the elastic launching elements situated in retention slots in the brackets.

2. The toy projectile launching assembly of claim 1, wherein the upper first elastic launching element and the lower second elastic launching element are each independently removably attached to the rigid left elastic support and the rigid right elastic support.

3. The toy projectile launching assembly of claim 1, wherein both ends of the first elastic launching element and both ends of the second elastic launching element are each removably attached to two different removable brackets situated within and attached to the lower surface side of the rigid left elastic support and the rigid right elastic support.

4. The toy projectile launching assembly of claim 1, wherein both ends of the upper first elastic launching element and both ends of the lower second elastic launching element include a sub-assembly including a mated double-nippled bead and hollow elastic combination configured for attaching the ends of the launching elements to two different removable brackets through retention slots.

5. The toy projectile launching assembly of claim 1, wherein the interior left elastic support and the interior right elastic support each include an axle-roller assembly to accommodate freely reversible stretch, bend, run, or roll of the first and the second elastic launching elements about the roller-axle subassembly, and to reduce frictional wear of the first and second elastic launching elements during launching of a projectile.

6. The toy projectile launching assembly of claim 5, wherein each axle-roller assembly is reversibly attached to the interior left elastic support and the interior right elastic support.

7. The toy projectile launching assembly of claim 5, wherein each axle-roller assembly is permanently attached to the interior left elastic support and an interior right elastic support.

8. The toy projectile launching assembly of claim 1, further comprising a handle attached to the lower surface at the flat base portion.

9. The toy projectile launching assembly of claim 8, wherein the handle is reversibly attachable-detachable to the lower surface of the platform and extends substantially orthogonally downwardly from the lower surface of the flat base portion.

10. The toy projectile launching assembly of claim 8, wherein the handle is permanently attached to the lower surface to the platform.

11. The toy projectile launching assembly of claim 8, further comprising an arm support structure having a left side and right side that extends downwardly and rearwardly from the platform and the handle is attached to the lower surface at the flat base portion.

12. The toy projectile launching assembly of claim 10, further comprising an arm support strap attached to the left side and right side of the arm support structure.

13. The toy projectile launching assembly of claim 12, wherein the arm support strap includes a clasp to adjust the tension of the strap.

14. The toy projectile launching assembly of claim 1, wherein the first elastic launching element and the second elastic launching element are coplanar and extend substantially parallel relative to each other above the flat base portion.

15. The toy projectile launching assembly of claim 1, wherein rear edges of the platform include one or more press-fit fasteners for removably receiving and holding one or more toy projectiles.

16. The toy projectile launching assembly of claim 8, wherein the handle comprises a pistol grip.

17. A toy projectile launching assembly for launching toy projectiles, comprising:

a rigid platform defined by a shallow "V-shaped" structure;

the rigid platform having an upper surface and a lower surface;

the rigid platform having a flat base portion;

the rigid platform having a left rigid extension and a right rigid extension, both left and right rigid extensions extend upwardly above the upper surface of the flat base portion and edges of the flat base portion, wherein the left rigid extension and the right rigid extension form respective upward left and right legs of the shallow "V-shaped" structure, and the flat base portion is situated at the vertex of the shallow "V-shaped" structure;

a distal end of the rigid left extension having a rigid exterior left elastic support, a distal end of the rigid right extension having a rigid exterior right elastic support, wherein the rigid exterior left elastic support and the rigid exterior right elastic support are attached to the rigid platform from below the upper surface;

the rigid platform having a rigid interior left elastic support and a rigid interior right elastic support that are situated between the rigid exterior left elastic support and the rigid exterior right elastic support, wherein the rigid interior left elastic support and the rigid interior right elastic support are attached to the rigid platform above the upper surface;

an upper first elastic launching element that extends continuously from the exterior left elastic support, through the interior left elastic support and the interior right elastic support, then to the exterior right elastic support, and the upper first elastic launching element is attached at one end to the left exterior elastic support and the other end to the right exterior elastic support;

a lower second elastic launching element, that is situated below the upper first elastic launching element, and the lower second elastic launching element extends continuously from the interior left elastic support, through the interior left elastic support and the interior right elastic support, then to the exterior right elastic support, and the lower second elastic launching element is attached at one end to the left exterior elastic support and the other end to the right exterior elastic support;

wherein the interior left elastic support and the interior right elastic support each include an axle-roller assembly to accommodate movement of the upper first and the lower second elastic launching elements about the roller-axle subassembly, and to reduce frictional wear of the upper first and lower second elastic launching elements when stretched and relaxed;

the rigid platform having a pistol grip handle attached perpendicularly to the lower surface near the underside of the flat base portion and extending angularly rearwardly;

the rigid platform having an arm support structure having a left side and a right side attached to the left side and the right side of the flat base, wherein the arm support extends downwardly and rearwardly from the rigid platform;

the rigid platform having an arm support strap attached to the left side and the right side of the arm support structure; and wherein the rigid platform is a monolithic molded plastic.

18. The toy projectile launching assembly of claim 17, further comprising at least one aperture passing through the upper and lower surfaces of each of the left and right rigid extensions to increase the overall structural strength and reduce the overall weight of the launching assembly.

19. The toy projectile launching assembly of claim 17, wherein the underside of the assembly from beneath the interior left elastic support and the interior right elastic support to the rear of the rigid platform is hollow to increase the overall structural strength and reduce the overall weight of the launching assembly.

* * * * *